US007591551B2

(12) United States Patent
Imoto et al.

(10) Patent No.: US 7,591,551 B2
(45) Date of Patent: Sep. 22, 2009

(54) IMAGE FORMING APPARATUS

(75) Inventors: Shinji Imoto, Tokyo (JP); Yoichi Ito, Kanagawa (JP); Seiichi Kogure, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 260 days.

(21) Appl. No.: 10/563,698

(22) PCT Filed: May 9, 2005

(86) PCT No.: PCT/JP2005/008813

§ 371 (c)(1),
(2), (4) Date: Jan. 5, 2006

(87) PCT Pub. No.: WO2005/108253

PCT Pub. Date: Nov. 17, 2005

(65) Prior Publication Data

US 2007/0109385 A1 May 17, 2007

(30) Foreign Application Priority Data

May 12, 2004 (JP) ..... 2004-142378

(51) Int. Cl.
*B41J 2/01* (2006.01)

(52) U.S. Cl. ..... 347/104; 347/34; 347/55; 399/401

(58) Field of Classification Search ..... None
See application file for complete search history.

(56) References Cited

U.S. PATENT DOCUMENTS 3,717,801 A * 2/1973 Silverberg ..... 361/234
5,121,170 A * 6/1992 Bannai et al. ..... 399/303
5,896,148 A 4/1999 Fukushima et al.
5,966,151 A * 10/1999 Wakahara ..... 347/55
6,097,408 A 8/2000 Fukushima et al.
6,786,590 B2 * 9/2004 Maki et al. ..... 347/104
6,909,872 B2 * 6/2005 Eskey ..... 399/401
7,245,863 B2 * 7/2007 Kamiya ..... 399/301
2001/0028381 A1 * 10/2001 Kashiwagi et al. ..... 347/104
2002/0021312 A1 * 2/2002 Matsumoto ..... 347/1
2002/0044189 A1 * 4/2002 Kitajima et al. ..... 347/132
2002/0126193 A1 9/2002 Maki et al.
2004/0263603 A1 * 12/2004 Maki et al. ..... 347/104

FOREIGN PATENT DOCUMENTS

EP 0473178 A2 3/1992
EP 1238812 A1 9/2002

(Continued)

*Primary Examiner*—Matthew Luu
*Assistant Examiner*—John P Zimmermann
(74) *Attorney, Agent, or Firm*—Cooper & Dunham, LLP

(57) ABSTRACT

In an image forming apparatus, an AC bias is supplied to a conveyance belt, and the amount of charge on the printing side of a recording sheet is decreased. The charge of positive polarity and the charge of negative polarity which are different from each other are generated on the printing side of the sheet, so that both the charges are cancelled by each other and the charge on the printing side of the sheet is eliminated. Moreover, the charge eliminator eliminates the charge on the printing side of the sheet by the time the sheet is electrostatically attached to the conveyance belt and conveyed to a position where the sheet confronts the head.

12 Claims, 16 Drawing Sheets

FOREIGN PATENT DOCUMENTS

| | | |
|---|---|---|
| JP | 4-201469 | 7/1992 |
| JP | 5-8392 | 1/1993 |
| JP | 5-224571 | 9/1993 |
| JP | 7-53082 | 2/1995 |
| JP | 9-244423 | 9/1997 |
| JP | 9-254460 | 9/1997 |
| JP | 2000-351467 | 12/2000 |
| JP | 2002-46310 | 2/2002 |
| JP | 2003-103857 | 4/2003 |

* cited by examiner

IMAGE FORMING APPARATUS

TECHNICAL FIELD

The present invention relates to an image forming apparatus which comprises a head unit having a discharge nozzle for discharging an ink, and a conveyance unit confronting the head unit and conveying a recording sheet to a position where it confronts the head unit wherein the head unit discharges the ink from the discharge nozzle to the sheet so that an image is printed on the recording sheet.

BACKGROUND ART

Conventionally, the ink jet printer is known as an image forming apparatus which discharges the ink drop from the discharge nozzle of the head unit and forms an image on the recording sheet from the paper cassette.

In the ink jet printer, the ink drop discharged from the discharge nozzle directly reaches the sheet and the image is printed on the sheet. For this reason, in order to realize high quality of the image, it is necessary to raise the accuracy of positioning the ink drop on the recording sheet.

There have been some conceivable methods for raising the ink drop position accuracy: to keep the distance of the head and the sheet constant, to perform conveyance of the sheet with high accuracy, etc.

Japanese Laid-Open Patent Application No. 04-201469 and Japanese Laid-Open Patent Application No. 09-254460 disclose the method for conveying the sheet with high accuracy wherein the conveyance belt which conveys the sheet to the position where it confronts the head unit is charged uniformly, and the composition to electrostatically attach the sheet to the conveyance belt is provided.

However, as a result of charging the conveyance belt uniformly, when the sheet is electrostatically attached to the conveyance belt, the sheet is subjected to the dielectric polarization under the influence of the electric field of the conveyance belt. This dielectric polarization causes the charge with the polarity opposite to that of the conveyance belt to be generated at the conveyance belt side of the sheet, and causes the charge with the same polarity as that of the conveyance belt to be generated at the printing side of the sheet.

Simultaneously with this, the actual charge with the polarity opposite to the conveyance belt moves gradually from the interior of the sheet to the conveyance belt side of the sheet, and the actual charge with the same polarity as the conveyance belt moves gradually from the interior of the sheet to the printing side of the sheet. For this reason, while the charge on the conveyance belt and the charge on the side of the conveyance belt of the sheet are balanced gradually, the electric field of the conveyance belt become weaker and the amount of charge by the dielectric polarization generated on the sheet also decreases. By the time that the sheet is conveyed by the conveyance belt to the position where it confronts the head unit, most of the charge on the printing side of the sheet becomes the actual charge.

As shown in FIG. 21(*a*), the potential difference arises between the sheet on the conveyance belt 120 and the head 130 under the influence of the actual charge on the printing side of the sheet, and the electric field occurs. For this reason, under the influence of the electric field, the ink drop discharged from the discharge nozzle 131 of the head 130 is charged as shown in FIG. 21(*b*).

Consequently, the flight of the ink drop is disturbed under the influence of the electric field between the sheet and the head 130 and the impact position is thus deviated.

Moreover, as shown in (c) and (d) of FIG. 21, the ink mist flows backwards to the head 130, and the ink mist adheres to the discharge nozzle of the head 130, which will cause the problem in which the adhering ink interferes with the normal discharging of the ink from the head 130.

To obviate the problem, Japanese Laid-Open Patent Application No. 2003-103857 discloses the composition wherein the AC bias voltage is applied to the conveyance belt and the conveyance belt is charged alternately to one of the positive polarity and the negative polarity.

However, in the case of charging the conveyance belt alternately to one of the positive polarity and the negative polarity, a non-uniform electric field is generated in the perpendicular direction from the positive charge on the conveyance belt to the conveyance belt, but the electric field in the middle thereof is deviated toward the negative electric charge on the conveyance belt.

Since the electric field in the closed formation is generated on the conveyance belt, the influence of the electric field from the conveyance belt on the printing side of the sheet becomes weaker. Consequently, the amount of charge generated on the printing side of the sheet decreases.

Furthermore, if an extended time passes, the positive charge and the negative charge which move to the printing side of the sheet are attracted and canceled by each other. Consequently, by the time that the sheet is conveyed to the position where it confronts the head unit, any of the charge almost does not exist on the printing side of the sheet.

For this reason, the potential difference between the sheet and the head unit no longer arises, and the electric field does not occur. Therefore, it is suppressed that the ink drop is charged and the flight of the ink drop is disturbed and the impact position is deviated, or the ink mist flows backwards and adheres to the discharge nozzle of the head.

In order to eliminate the actual charge on the printing side of the sheet, it is necessary that a certain time passes. For this reason, in order to eliminate the actual charge on the sheet to an extent that the potential difference does not occur even if the sheet is conveyed to the position where it confronts the head unit, it is necessary to secure the time from the instant the sheet is electrostatically attached to the conveyance belt to the instant the sheet arrives at the position where it confronts the head unit.

Conventionally, if the conveyance speed of the sheet is raised for improvement of the printing speed, the actual charge on the printing side of the sheet cannot be eliminated by the time the sheet arrives at the position where it confronts the head unit. Therefore, the charge remains on the printing side of the sheet and the electric field occurs between the sheet and the head unit. For this reason, there is the problem that the impact position of the ink drop is deviated, or the ink mist adheres to the head discharge nozzle, and it is difficult to obtain the high quality image with the conventional image forming apparatus.

SUMMARY

In an aspect of the present disclosure, an image forming apparatus is provided which suppresses the deviation of the impact position of the ink drop and the adhering of the ink mist to the head discharge nozzle even if the conveyance speed of the sheet is raised to increase the printing speed, and is able to obtain the high quality image.

In another aspect of the present disclosure, an image forming apparatus comprises a head unit having a discharge nozzle for discharging an ink wherein the head unit discharges the ink from the discharge nozzle to print an image on a recording sheet, a conveyance unit confronting the head unit and conveying the sheet in a movement direction to a position where the sheet confronts the head unit, a charging unit provided in the conveyance unit to supply an AC bias voltage to the conveyance unit, and a charge eliminating unit eliminating charge of a printing surface of the recording sheet, the charge eliminating unit being disposed at a position on a downstream side of the charging unit in the movement direction of the conveyance unit and on an upstream side of the head unit.

The above-mentioned image forming apparatus may be configured so that the charge eliminating unit comprises a conductive member.

The above-mentioned image forming apparatus may be configured so that the charge eliminating unit is constituted by a pressure roller which pushes the recording sheet against the conveyance unit.

The above-mentioned image forming apparatus may be configured so that the charge eliminating unit is constituted by an electric conduction brush.

The above-mentioned image forming apparatus may be configured so that the electric conduction brush has a width that is larger than (½)X where X denotes a distance from a positively charged portion of the conveyance unit to a negatively charged portion of the conveyance unit.

The above-mentioned image forming apparatus may be configured to further comprise a voltage supplying unit supplying to the charge eliminating unit a voltage of polarity which is opposite to a charging polarity of a conveyance belt of the conveyance unit at a position where the conveyance belt confronts the charge eliminating unit.

The above-mentioned image forming apparatus may be configured so that a movement distance of the conveyance unit from the charging unit to the charge eliminating unit is represented by a distance that is obtained by subtracting (½)X from an integral multiple of X where X denotes a distance from a positively charged portion of the conveyance unit to a negatively charged portion of the conveyance unit.

The above-mentioned image forming apparatus may be configured to further comprise a control unit controlling the voltage supplying unit so that no voltage is supplied to the charging unit and the charge eliminating unit when movement of the conveyance unit is stopped.

The above-mentioned image forming apparatus may be configured to further comprise a control unit controlling the voltage supplying unit to vary the voltage supplied to the charge eliminating unit, depending on a kind of the recording sheet.

The above-mentioned image forming apparatus may be configured so that the conveyance unit comprises a conveyance belt wound around at least two rollers, and the charge eliminating unit is disposed on a downstream side of a position where the recording sheet is conveyed along a curvature of each of the at least two rollers by the conveyance belt, in the movement direction of the conveyance unit.

The above-mentioned image forming apparatus may be configured so that the charge eliminating unit is disposed at a position near the head unit.

The above-mentioned image forming apparatus may be configured to further comprise: a sheet reversing unit reversing the recording sheet; and a sheet separating unit separating the charge eliminating unit from the recording sheet when the conveyance unit is reversely rotated to convey the recording sheet after the image is printed on the printing surface of the recording sheet, to the sheet reversing unit.

The above-mentioned image forming apparatus may be configured to further comprise a heating unit heating the recording sheet, the heating unit being disposed at a position on an upstream side of the charge eliminating unit in the movement direction of the conveyance unit.

According to the present invention, the AC bias voltage is supplied to the conveyance unit so that the conveyance unit is charged alternately to one of positive polarity and negative polarity and the closed electric field on the conveyance belt is generated. The amount of charge on the printing surface of the recording sheet is decreased, and the positive charge and the negative charge are generated on the printing surface of the recording sheet so that both the charges are canceled by each other. Thereby, the charge on the printing side of the sheet is eliminated, and the occurrence of the electric field between the sheet and the head is suppressed.

Moreover, by the time the recording sheet is electrostatically attached to the conveyance unit and conveyed to the position where the sheet confronts the head, the charge eliminating unit eliminates the charge on the printing surface of the sheet. Thereby, even if the conveyance speed is increased to shorten the time for the sheet to arrive at the position and canceling the positive charge and the negative charge by each other is difficult, the charge eliminating unit eliminates the charge on the printing surface of the sheet. It is possible to eliminate most of the charge existing on the printing surface of the recording sheet even in such a case.

Accordingly, even if the conveyance speed is increased, it is possible to suppress the occurrence of the electric field between the recording sheet and the head unit by the elimination of the charge on the printing surface of the recording sheet by the charge eliminating unit and the elimination of the charge on the printing surface of the recording sheet by supplying the AC bias voltage to the conveyance unit.

This makes it possible to suppress the charging of the ink drop discharged from the head unit, the deviation of the impact position of the ink drop, or the backward flowing of the ink mist and adhering to the discharge nozzle of the head unit, which will interfere with the normal discharging of the ink by the head unit. Consequently, even if the high-speed printing is implemented, the high-quality image without disturbance in the image can be obtained.

Other objects, features and advantages of the present invention will be apparent from the following detailed description when reading in conjunction with the accompanying drawings.

BEST MODE FOR CARRYING OUT THE INVENTION

A description will now be given of the preferred embodiments of the invention with reference to the accompanying drawings.

Hereinafter, the ink jet printer (also called the printer) will be explained as one preferred embodiment of the image forming apparatus in which the present invention is embodied.

Figure 1:
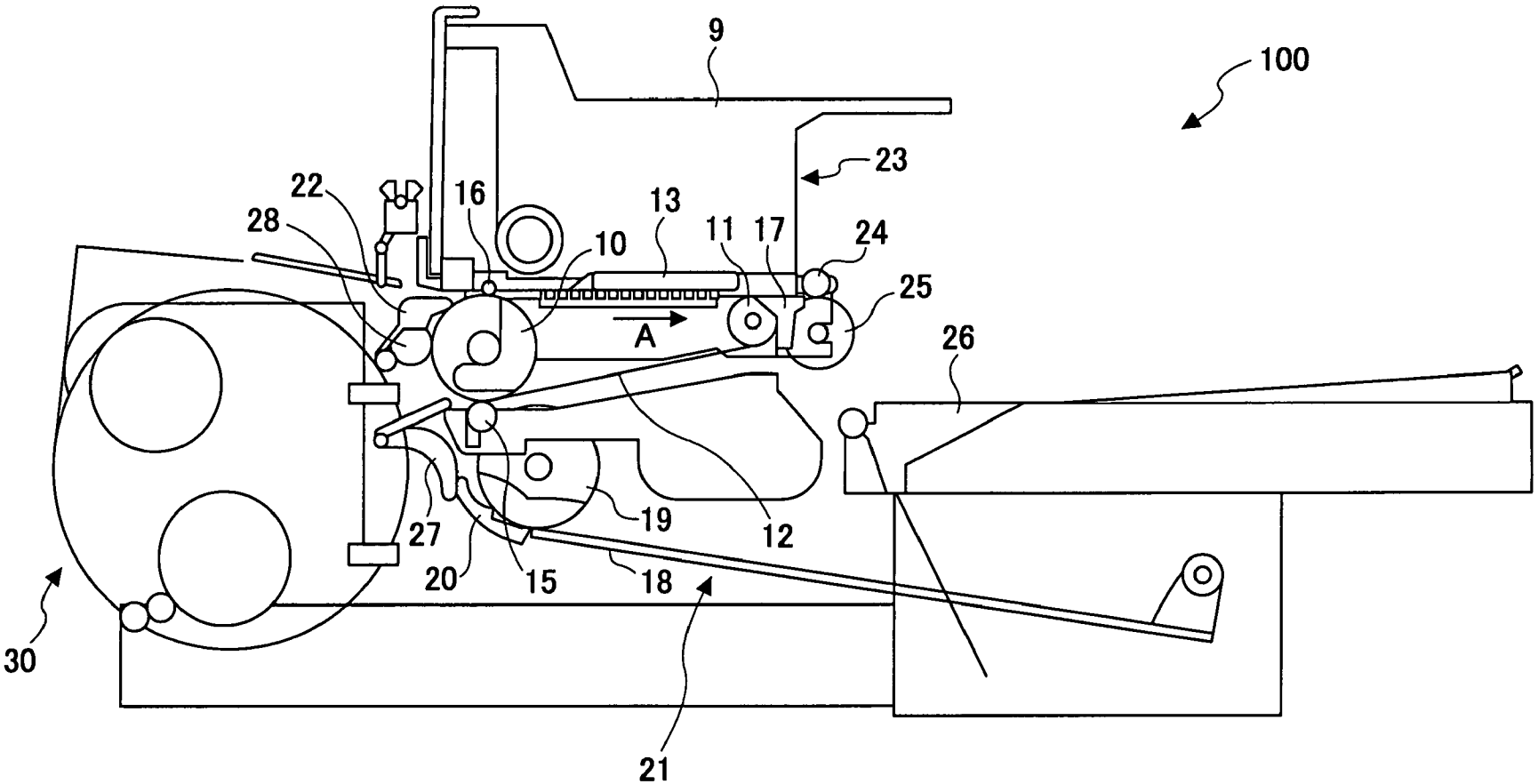
FIG. 1 is a diagram showing the outline composition of the ink jet printer.

FIG. 1 shows the outline composition of the printer in the preferred embodiment of the invention.

As shown in FIG. 1, the printer 100 comprises the printing mechanism unit 23 which has the carriage 9 which is movably held. The carriage 9 is movable in the direction (the main-scanning line) perpendicular to the conveyance direction of the recording sheet by means of the drive unit (which is not illustrated). Moreover, the printer 100 comprises the conveyance unit 21 which conveys the sheet from the sheet feeding tray 18 to the ejection tray 26 via the position where the sheet confronts the printing mechanism unit 23.

The printing head 13 which has the discharge nozzles for discharging the respective inks of the colors, such as Y (yellow), M (magenta), C (cyan) and B (black), to the recording sheet is arranged on the carriage 9 of the printing mechanism unit 23.

The conveyance unit 21 comprises the sheet feeding tray 18 in which a plurality of sheets are loaded, the feed roller 19 which sends out the sheet from the sheet feeding tray 18 to the conveyance roller 10, the separation pad 20 which separates one sheet from the plurality of sheets in the sheet feeding tray 18 and sends out the sheet to the conveyance roller 10, and the feed guide 27 which guides movement of the sheet fed from the sheet feeding tray 18.

The conveyance roller 10 gives tension to the conveyance belt 12 together with the tension roller 11. The conveyance belt 12 conveys the sheet fed from the sheet feeding tray 18 to the position where the sheet confronts the head 13.

By the drive unit (which is not illustrated), the conveyance roller 10 is rotated clockwise in FIG. 1, so that the conveyance belt 12 is moved in the endless manner in the direction indicated by the arrow A in FIG. 1.

In addition, the conveyance unit 21 further comprises the pressure roller 16 which pushes the sheet against the conveyance roller 10, the sheet guide 22 which guides movement of the sheet, the guide roller 28, and the charging roller 15 which charges the conveyance belt 12 surface.

The sheet guide 22 has the radius of curvature larger than the radius of curvature of the conveyance roller 10 in order to form the conveyance path for changing the conveyance direction of the sheet, which is upwardly conveyed almost in the perpendicular direction along with the curvature of the conveyance roller 10, about 90 degrees.

Since the pressure roller 16 pushes the conveyance belt 12 against the conveyance roller 10, the frictional force between the conveyance belt 12 and the conveyance roller 10 is increased. This serves to prevent the shipping of the conveyance belt 12 to the conveyance roller 10, and it is possible to make the conveyance of the sheet with sufficient accuracy.

Moreover, the charge eliminating member 29 (FIG. 18) which eliminates the charge on the printing side of the sheet is disposed between the charging roller 15 and the head 13. Moreover, provided at the position which confronts the head 13 is a conveyance guide plate (not shown) which guides the conveyance belt 12, and this conveyance guide plate is disposed on the side of the inner peripheral-surface of the conveyance belt 12.

Moreover, the conveyance unit 21 further comprises the separation member 17 which separates the sheet with the image printed thereon from the conveyance belt 12, the ejection roller 25 which ejects the sheet to the ejection tray 26, and the roller 24 which has the cross section in the star-like shape.

Furthermore, the sheet reversing unit 30 which reverses the sheet is provided in the printer 100 of this embodiment, and the printer 100 is capable of printing the image on both sides of the sheet.

Figure 2:
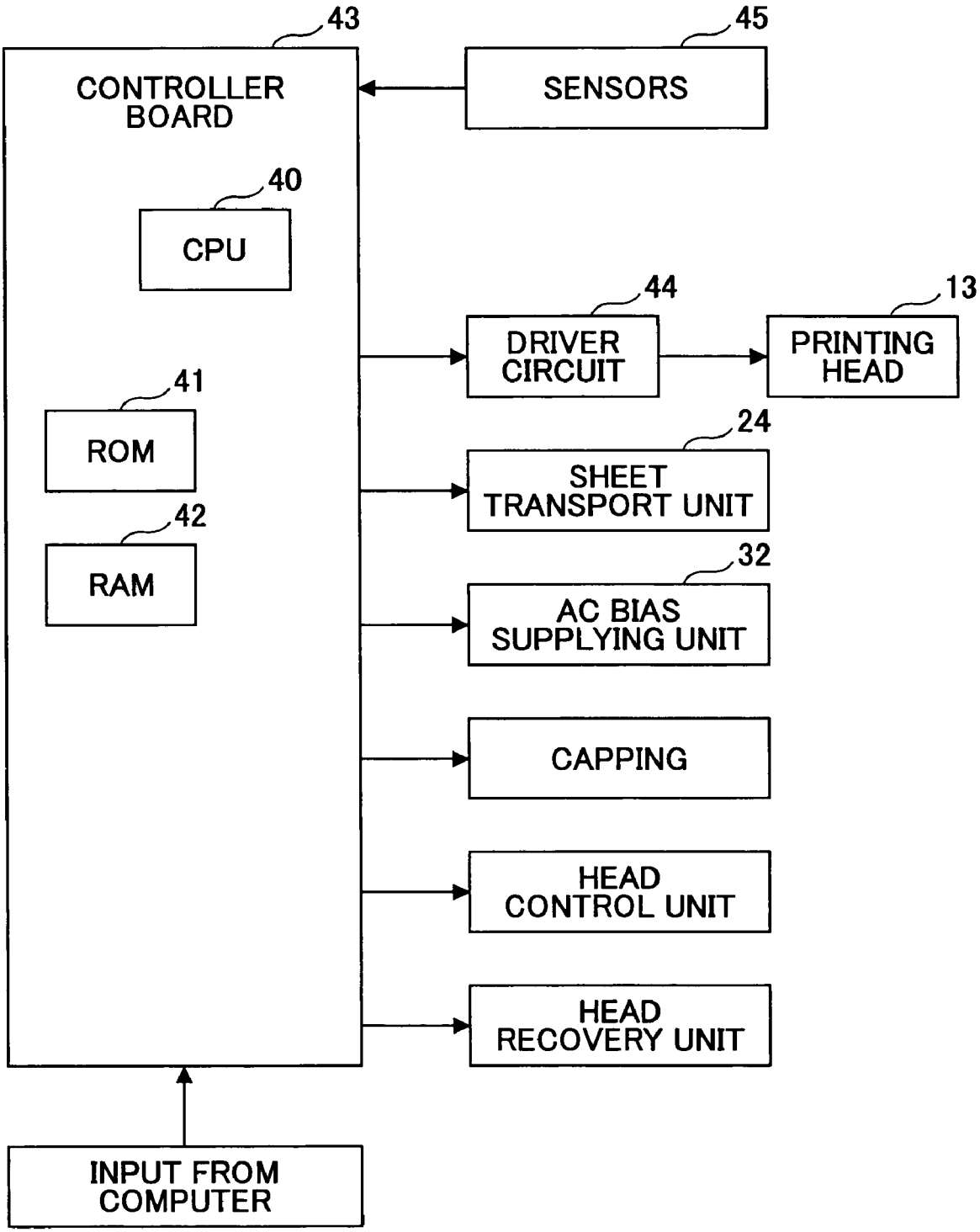
FIG. 2 is block diagram showing the composition of the controller board of the printer.

FIG. 2 shows the composition of the controller board 43 of the printer 100. This controller board 43 comprises the CPU 40, the ROM 41 and the RAM 42. The sensors 45, the drive circuit 44 for driving the head 13, the conveyance unit 21, the AC bias supplying unit 32 which is connected to the charging roller 15, and so on are connected to the controller board 43. The AC bias supplying unit 32 will be explained later.

Next, the printing operation of the printer of the present embodiment will be explained.

The image signal is sent from the personal computer to the printer of this embodiment, and the printing is performed in accordance with the image signal.

First, the sheet is fed from the sheet feeding tray 18 to the conveyance roller 10 by the feed roller 19. The sheet fed from the sheet feeding tray 18 is guided by the guide member 22 and the pressure roller 16, and it is conveyed upward by the conveyance belt 12 almost in the perpendicular direction.

The surface of the conveyance belt 12 is charged with the charging roller 15, so that the sheet is electrostatically attached to the conveyance belt 12.

The sheet attached to the conveyance belt is guided by the sheet guide 22 and the pressure roller, the direction of the sheet conveyance is changed about 90 degrees, and the sheet is conveyed almost in the horizontal state to the printing position where the sheet confronts the head 13.

When the sheet conveyed by the conveyance belt 12 arrives at the position where the sheet confronts the head 13, the movement of the conveyance belt 12 is suspended and the movement of the sheet is also stopped.

And while the carriage 9 is moved forward or backward in the directions of the main scanning line according to the image signal, the head 13 discharges the ink drop to the predetermined part of the sheet being stopped, so that the image for one line is printed on the sheet. The one line means the range in the direction of the sub-scanning line in which the head 13 can print the image on the sheet.

After printing of the image for one line in the direction of the main scanning line is completed, the drive of the conveyance belt 12 is performed for the predetermined time, the sheet is moved by the one line in the direction toward the ejection tray 26, and the movement of the sheet is stopped.

Similar to the foregoing, according to the image signal, while the carriage 9 is moved forward or backward in the main scanning direction, the head 13 prints the image for one line. The above procedure is repeated by the predetermined number of times, and the entire image is printed on the sheet.

Thus, when repeating the conveyance and stopping of the sheet and the forming of the image on the sheet, the sheet is electrostatically attached to the conveyance belt, and is possible to stably convey the sheet to the position where the sheet confronts the head. Moreover, since the sheet is pushed against the conveyance belt by the pressure roller 16, the sheet can be electrostatically attached to the conveyance belt 12 certainly.

The sheet with which the entire image is printed is separated from the conveyance belt 12 by the separation member 17, and it is conveyed to the ejection tray 26 by the ejection roller 25 and the roller 24 so that the printed sheet is ejected.

In the case of the double-sided printing mode, after the entire image is printed on one side of the sheet, the conveyance belt 12 is reversely rotated, and the sheet is conveyed to the sheet reversing unit 30. The sheet reversed by the sheet reversing unit 30 is again guided around the guide member 22 or the pressure roller 16 and conveyed by the conveyance belt 12.

When the sheet arrives at the position where the sheet confronts the head unit 13, the same procedure as described above is performed and the entire image is printed on the other side of the sheet.

And the sheet with the entire images printed on both sides is separated from the conveyance belt 12 by the separation member 17, and it is conveyed by the ejection roller 25 and the roller 24 and ejected to the ejection tray 26.

Figure 3A:
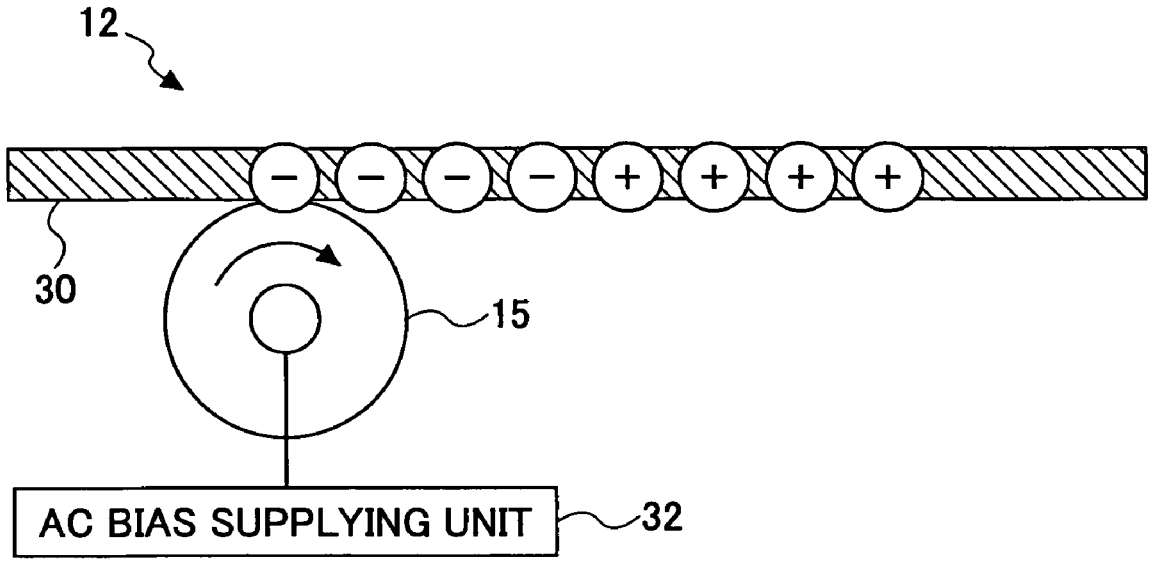
FIG. 3A and FIG. 3B are diagrams showing the composition of the conveyance belt.
Figure 3B:
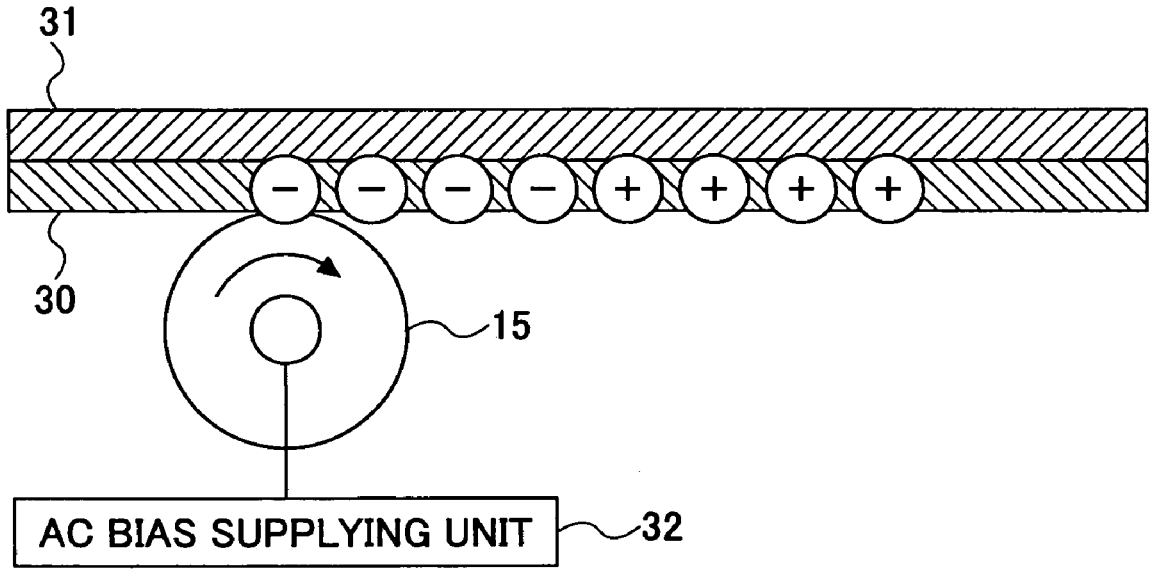

Next, the conveyance belt 12 will be explained. FIG. 3A and FIG. 3B are the cross-sectional diagrams of the conveyance belt 12.

Either the endless belt of the one-layer structure which comprises the insulated layer 30 as shown in FIG. 3A or the endless belt of the two-layer structure which comprises the insulated layer 30 and the electric conduction layer 31 as shown in FIG. 3B may be used as the conveyance belt 12.

In the conveyance belt 12 of the two-layer structure, the insulated layer 30 serves as the outer peripheral surface where it contacts the charging roller 15 and the sheet. The electric conduction layer 31 serves as the inner peripheral surface in contact with the conveyance roller 12 or the tension roller 11.

It is possible to provide the conveyance belt 12 in the endless configuration by using the fabricated type. Or both ends of the conveyance belt 12 may be joined together by the adhesive etc. and it is possible to make it the endless configuration. The insulated layer 30 is formed with the material which does not contain any electric conduction control material, such as the resin, such as PET, PEI, PVDF, PC, ETFE, and PTFE, and the elastomer.

As for the volume resistivity of the insulated layer 30, it is desirable that it is more than $10^{12}$ [Ωcm]. More preferably, the volume resistivity of the insulated layer 30 is $10^{15}$ [Ωcm]. The electric conduction layer 31 comprises the same resin or elastomer as the insulated layer 30. The electric conduction layer 31 may contain the carbon as the electric conduction control material, and it is adjusted so that the volume resistivity thereof may be set to $10^5$-$10^7$ [Ωcm].

The charging roller 15 is formed by the conductive member having the volume resistivity of $10^6$-$10^9$ [Ωcm]. Moreover, the AC bias supplying unit 32 which supplies the +2 kV AC bias voltage to the charging roller 15 is connected to the charging roller 15.

Although the various waves, such as the sine wave and the triangular wave, can be used for AC bias applied to the charging roller 15, considering as the square wave is desirable. And the voltage from which polarity differs by turns is applied to the insulated layer 30 of the conveyance belt 12 with the charging roller 15, and the polar charge which is different in the insulated layer 30 of the conveyance belt 12 is charged by turns.

Figure 4A:
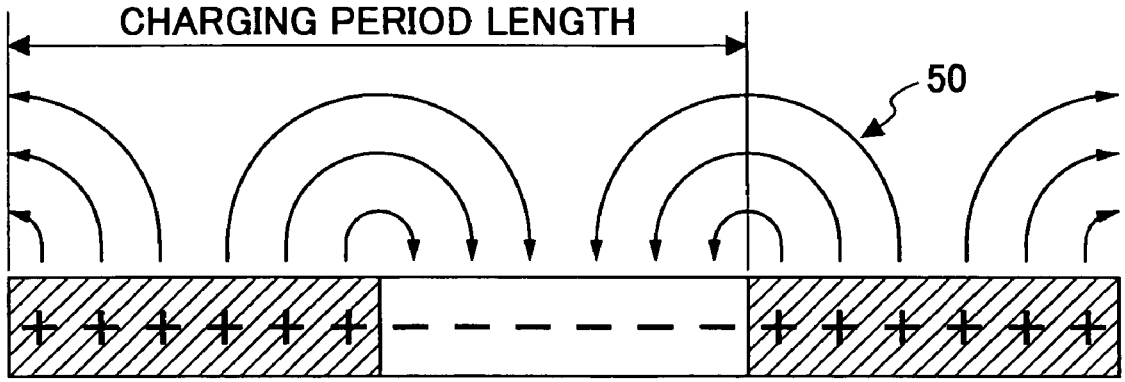
FIG. 4A is a diagram for explaining the electric field on the conveyance belt.

As shown in FIG. 4A, on the conveyance belt, it generated from the positive charge on the conveyance belt 12 perpendicularly to the conveyance belt, and minute electric side which are crooked on the way and face to the minus electric charge on the conveyance belt 12 occur.

Since the volume resistivity of the insulated layer 30 is set up more than $10^{12}$ [Ωcm] at this time, positive and negative charge which are charged on the insulated layer 30 move, and the mutual charge is not negated. Therefore, positive which is stabilized on the conveyance belt 12 and negatively charged can be acquired by turns.

Figure 4B:
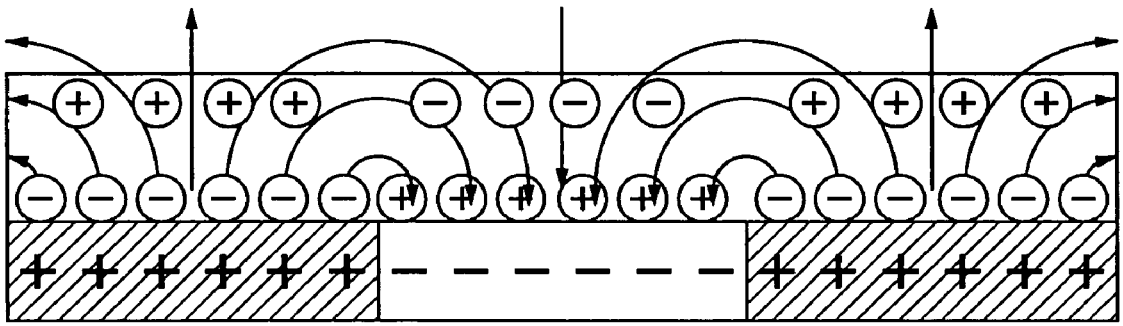
FIG. 4B is a diagram for explaining the polarization of the charge of the sheet.

If the sheet conveyed from the sheet feeding tray 18 is conveyed by the conveyance belt 12, the sheet will carry out the dielectric polarization by the electric field 50 generated from the conveyance belt 12 as shown in FIG. 4B.

And the charge of the charging polarity on the conveyance belt 12 which confronts by this dielectric polarization, and reversed polarity occurs in the conveyance belt 12 side of the sheet, and the sheet carries out electrostatic attaching on the conveyance belt 12.

There are few charges generated by the electric field of the conveyance belt in the printing side of the sheet on the other hand since the printing side of the sheet has little influence of the electric field generated from the conveyance belt 12 compared with the charge generated in the conveyance belt 12 side.

The electric field from the conveyance belt is crooked circularly in the conveyance belt upper part. For this reason, the electric field near the boundary between the portion in which the conveyance belt is positively charged, and the portion in which the conveyance belt is negatively charged become parallel to the sheet, and the electric potential does not occur on the printing side of the sheet.

Consequently, the charge is not generated at the sheet printing side located near the boundary of the portion into which the conveyance belt 12 is positively charged, and the portion which carried out negatively charged. Therefore, the charge generated at the printing side of the sheet decreases compared with the charge generated at the conveyance belt 12 side.

And if the time has elapsed, the charge of the charging polarity on the conveyance belt 12 which confronts, and reversed polarity will move to the conveyance belt side of the sheet from the interior of the sheet gradually, and will weaken the influence of the electric field of the conveyance belt. And the amount of charge generated by the dielectric polarization under the influence of the electric field of the conveyance belt is decreased.

Moreover, the charge the charging polar on the conveyance belt 12 which confronts simultaneously with this, and polar this moves to the printing side of the sheet from the interior of the sheet gradually.

Moreover, although the surface electrical resistance of the sheet is $10^{11}$-$10^{13}$ [Ω/□] and it is high resistance, since it has the conductive property, the charge which moved to the printing side and which came is in the unstable state.

Therefore, with time, the charge by the side of the printing side of the sheet draws each other with different polarity, disappears, and reduces the potential by the side of the sheet printing side.

On the other hand, since the powerful electric field from the conveyance belt act, like the printing side of the sheet, the charge negates the conveyance belt side of the sheet, and there is and it does not disappear. Thus, since the charge by the side of the sheet printing side is lost, the electrostatic attaching power of the sheet and the conveyance belt increases.

Electric field stop moreover, occurring between the heads the printing side of the sheet, as a result of negating the charge by the printing side of the sheet and the potential by the printing side of the sheet becoming low. Therefore, the ink drop discharged from the head can suppress that produce the deviation in the impact position or ink mist adheres to the head in response to the influence of electric field.

Figure 5:
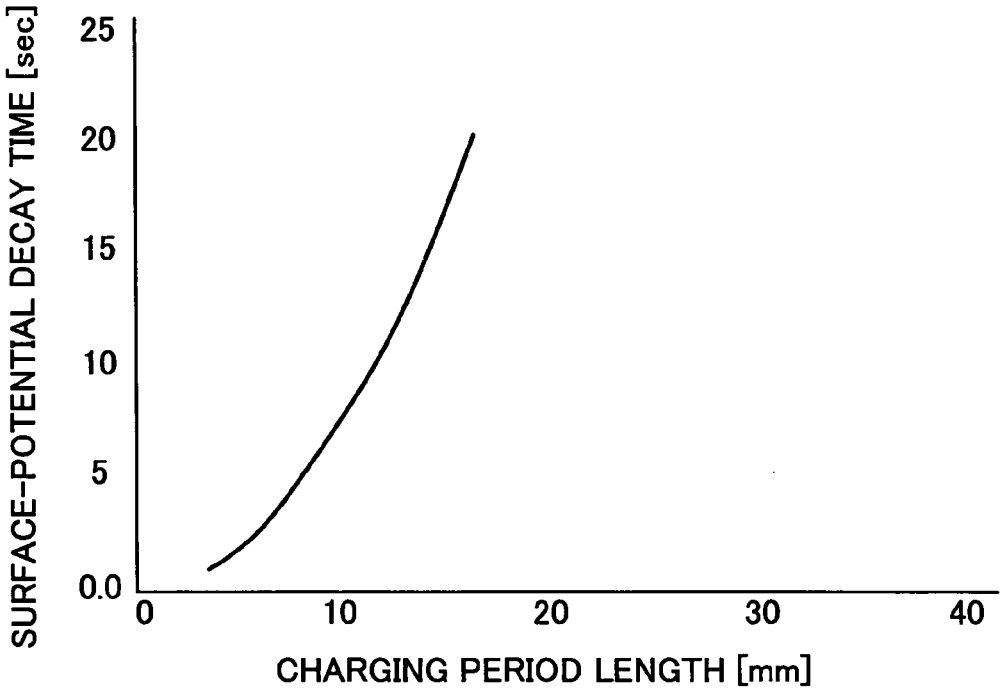
FIG. 5 is a diagram for explaining the relation between the surface potential decay time and the charging period length.

FIG. 5 is a diagram for explaining the relation between the surface-potential decay time and the charging period length. The applied voltage to the conveyance belt 12 set to ±2 kV, and set the sheet surface potential at this time as less than 500V.

In addition, the charging period length is the distance from the position which changes from negative (positive) charging of the conveyance belt 12 to positive (negative) charging to the position which changes from the following negative (positive) charging to positive (negative) charging, as shown in FIG. 4A.

Moreover, the charging period length made it differ by changing the conveyance speed of the conveyance belt 12. That is, when conveyance speed is made late when the charging period length is shortened, and the charging period length is lengthened, conveyance speed is carried out early.

As FIG. 5 shows, it turns out that the decay time of surface potential is proportional to the 2nd about power of the charging period length.

Therefore, if the charging period length is shortened, it turns out that the potential decay time can be shortened.

As the charging period length becomes long, as for this, the charging portion of positive (negative) polarity becomes longer.

Consequently, the distance which moves in order that the charge near the center of the charging portion of positive (negative) polarity may deny the charge of negative (positive) polarity becomes long, and the real resistance for the charge moving becomes high.

Thus, as a result of the distance of the charge of positive/negative polarity separating, time until positive and negative charge pay well and it negates each other increases. Consequently, the decay time of potential became long.

Figure 6:
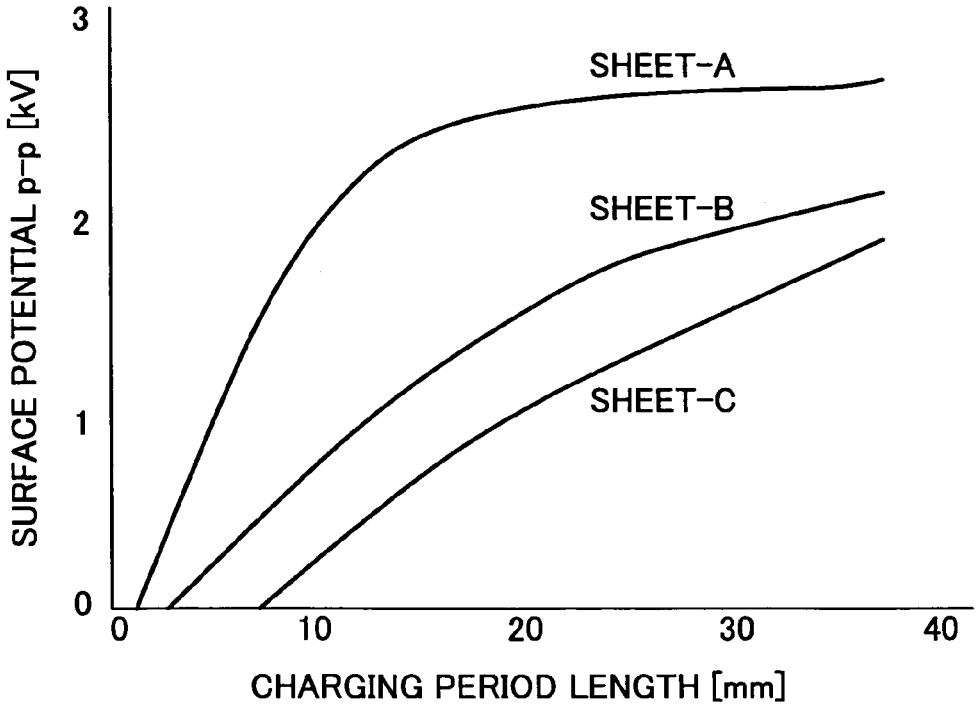
FIG. 6 is a diagram for explaining the relation between the surface potential and the charging period for each sheet.

FIG. 6 is a diagram for explaining the relation between the three kinds of sheet surface potentials from which the surface resistivity for which it asked from the experiment differs, and the charging period length.

The surface resistivity of Form A is $1.8\times10^{13}$ [Ω/□] the surface resistivity of Form B is $1.2\times10^{12}$ [Ω/□], and the surface resistivity of Form C is $5\times10^{11}$ [Ω/□].

Moreover, the applied voltage to the conveyance belt 12 set to ±2 kV, and the sheet contacted the conveyance belt 12 and measured the surface potential of 1.6 seconds after.

If the charging period length is shortened irrespective of the surface resistivity of the sheet as shown in FIG. 6, it turns out that surface potential of the sheet can be made low. This is considered that surface potential became low as are mentioned above and the charging period length becomes short, since the surface-potential decay time has the shorter short one of the charging period length.

Moreover, the electric field generated on the sheet surface increase, and the quantity of the charge which moves to the sheet surface increases, so that the charging period length is long. Therefore, surface potential became high, so that the charging period length is long.

Moreover, the sheet with the high surface resistivity is understood that surface potential is high compared with the sheet with the low surface resistivity. It is difficult to move the charge on the surface of the sheet, and, as for this, the amount of movements of the charge around unit time becomes small, so that the surface electrical resistance of the sheet is high.

Consequently, since the time when the charge on the surface of the sheet is negated becomes long, compared with the sheet with the low surface resistivity, as for the sheet with the high surface resistivity, surface potential is considered to have become high.

From the result of FIG. 5 and FIG. 6, if the charging period length is shortened, potential by the side of the printing side of the sheet can be made low, and the ink drop can suppress that produce the deviation of the impact position or ink mist adheres to the discharge nozzle of the head in response to the influence of electric field.

As a method of shortening the charging period length, it is possible to make conveyance speed of the conveyance belt 12 late. However, if conveyance speed of the conveyance belt 12 is made late, print time cannot become late and cannot carry out the high-speed printing.

Moreover, although shortening time of the one periodicity of AC bias is also considered, although voltage is started to 0V to ±2 kV, when The AC bias supplying unit 32 is 10 mSec necessity and there are, it is needed unit 40 msec a round term.

Although it is also possible to make voltage starting time quick by making the power supply capacity of the AC bias supplying unit 32 increase, the AC bias supplying unit 32 will be enlarged in this case, and it will lead to enlargement of the device, and the cost rise.

However, in the present embodiment, the charge eliminator 29 which removes the charge by the side of the sheet printing side between the charging roller 15 and the head 13 is printed, and the charge by the side of the sheet printing side is removed. Even if it speeds up conveyance and the charging period length benefits the high-speed printing long by this, by the time the sheet confronts with the head 13, potential by the side of the printing side of the sheet can be made low.

Therefore, the high-speed printing is made and the ink drop moreover discharged from the head can suppress that produce the deviation in the impact position or ink mist adheres to the head discharge nozzle in response to the influence of electric field.

The charge eliminating brush, the conductive roller, etc. can be used as a charge eliminator 29 which removes the above-mentioned charge by the side of the sheet printing side.

Moreover, the member which makes AC bias applied to the conveyance belt 12 and AC bias shifted the semicircle term apply to the sheet printing side can also be used as a charge eliminator 29.

A description will be given of the image forming apparatus in the preferred embodiment of the invention. In the present embodiment, the charge eliminating brush is provided as a charge eliminator 29 in the image forming apparatus.

Figure 7:
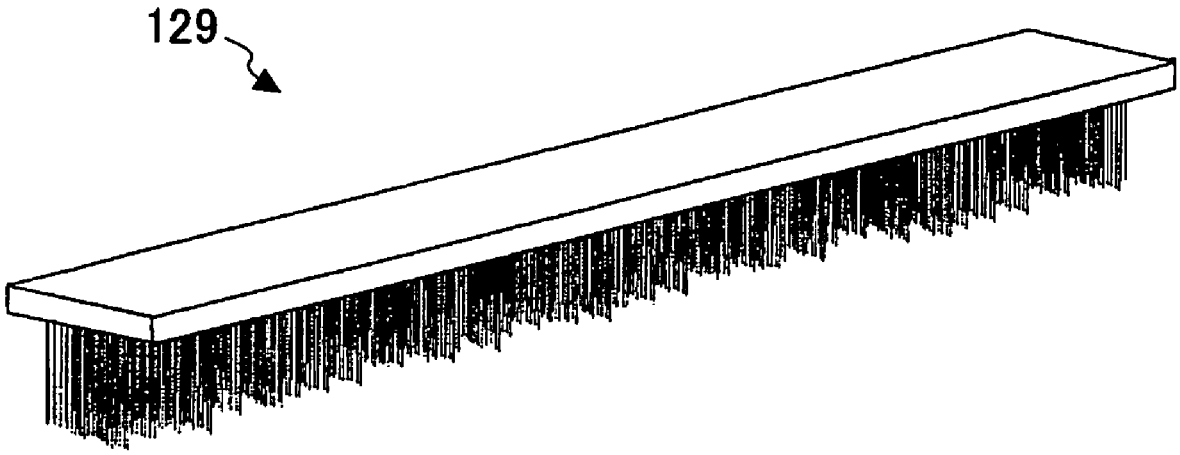
FIG. 7 is a perspective diagram showing the charge eliminating brush of large width.

FIG. 7 shows the composition of the charge eliminating brush 129 which has the large width and is provided as a charge eliminator in the image forming apparatus of the present embodiment.

The charge eliminating brush 129 shown in FIG. 7 is formed with a conductive material. For example, the material of the charge eliminating brush 129 may be the fibers of resin, such as acrylic resin or polyester resin, or the fibers of stainless steel with the diameter of about 8-20 micrometers with which the metal plating is used. Alternatively, the conductive carbon fibers in which the resin containing the carbon or the carbonized metal powder is carbonized may be used as the material of the charge eliminating brush 129.

The volume resistivity of the charge eliminating brush 129 is below $10^{11}$ [Ωcm], and it is more desirably below $10^{8}$ [Ωcm]. The material in which the carbon fibers are mixed with the nylon (registered trademark) fibers having the thickness of 15 micrometers and the length of 10 mm is used as the charge eliminating brush 129 of the present embodiment.

Moreover, the charge eliminating brush 129 of the present embodiment is provided as the charge eliminating brush having the large width which is larger than ½ of the charging period length X where X denotes the distance from a positively charged portion of the conveyance belt to a negatively charged portion of the conveyance belt.

Figure 8:
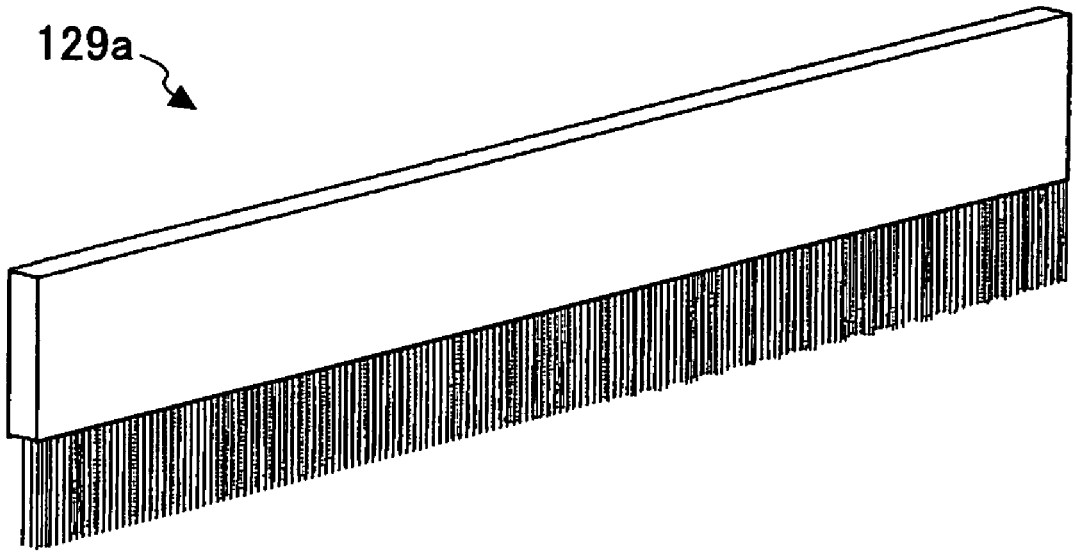
FIG. 8 is a perspective diagram showing the charge eliminating brush of small width.

FIG. 8 shows the composition of the charge eliminating brush 129*a* which has the small width which is smaller than ½ of the charging period length X.

Next, the measurement in which the charge elimination effect when installed in the printer is detected is carried out for each of the charge eliminating brush 129 of the large width (larger than the (½)X) of the present embodiment shown in FIG. 7 and the charge eliminating brush 129*a* of the small width (smaller than the (½)X) shown in FIG. 8. The result of the measurement is shown in FIG. 9.

Figure 9:
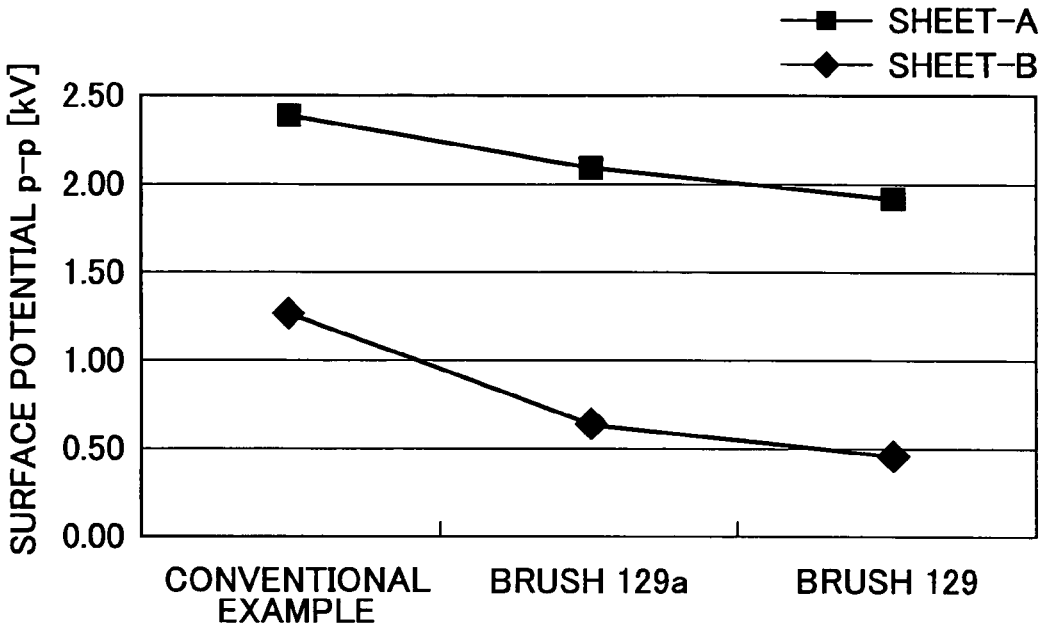
FIG. 9 is a diagram for explaining the difference in charge elimination effect between the charge eliminating brush of the large width and the charge eliminating brush of the small width.

In addition, the conventional example, shown in FIG. 9, is the result of the measurement when no charge eliminating brush is provided in the printer.

As shown in FIG. 9, when compared with the charge eliminating brush 129*a* of the small width, the charge eliminating brush 129 of the large width has a larger charge elimination effect. In the case of the charge eliminating brush 129*a* of the small width, the actual charge removed from the recording sheet moves to the ground connected to the charge eliminating brush, and the actual charge is negated and cancelled. For this reason, the electric discharging by this charge eliminating brush needs some additional time, and the charge eliminating brush itself tends to be charged. The charging of the charge eliminating brush will reduce the charge eliminating capacity. Consequently, it is conceivable that, when compared with the charge eliminating brush 129 of the large width, the charge elimination effect of the charge eliminating brush 129*a* of the small width falls.

On the other hand, in the case of the charge eliminating brush 129 of the large width, it has the width larger than ½ of the charging period length X in the conveyance direction, the charge eliminating brush 129 contacts both the negatively charged portion and the positively charged portion of the sheet. Namely, the charge eliminating brush 129 will remove the negative charge and the positive charge from the sheet.

Consequently, since the charge is negated within the charge eliminating brush, the charge eliminating brush 129 will not be charged easily. Therefore, the electric discharge capacity does not decline, and the charge eliminating brush 129 of the large width has a charge elimination effect larger than that of the charge eliminating brush 129*a* of the small width.

Figure 10:
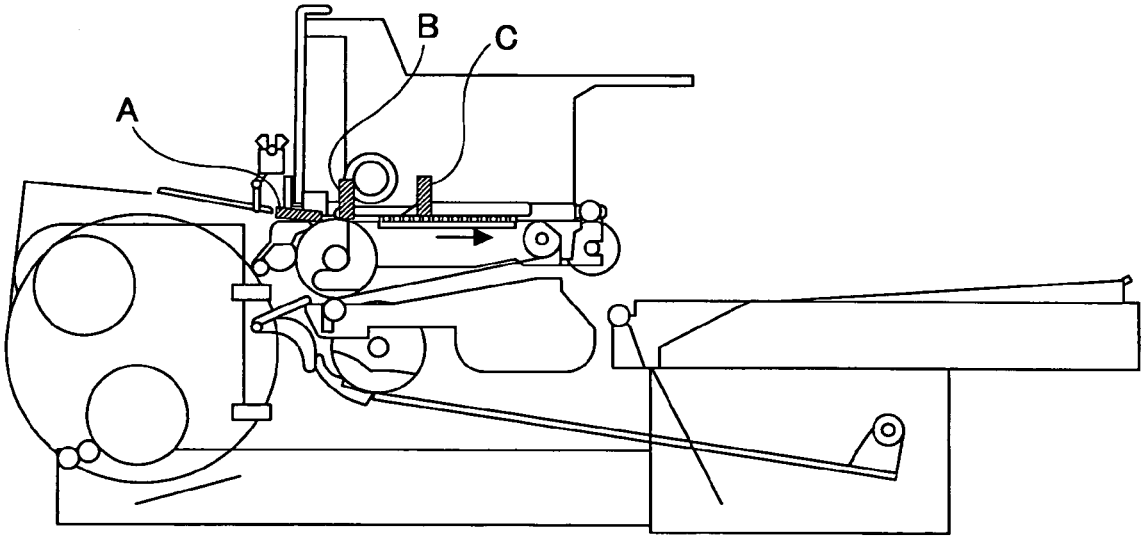
FIG. 10 is a diagram showing the arrangement positions of the charge eliminating brush.

Next, the arrangement position of the charge eliminating brush will be explained. FIG. 10 shows the arrangement positions A, B and C of the charge eliminating brush.

Figure 11:
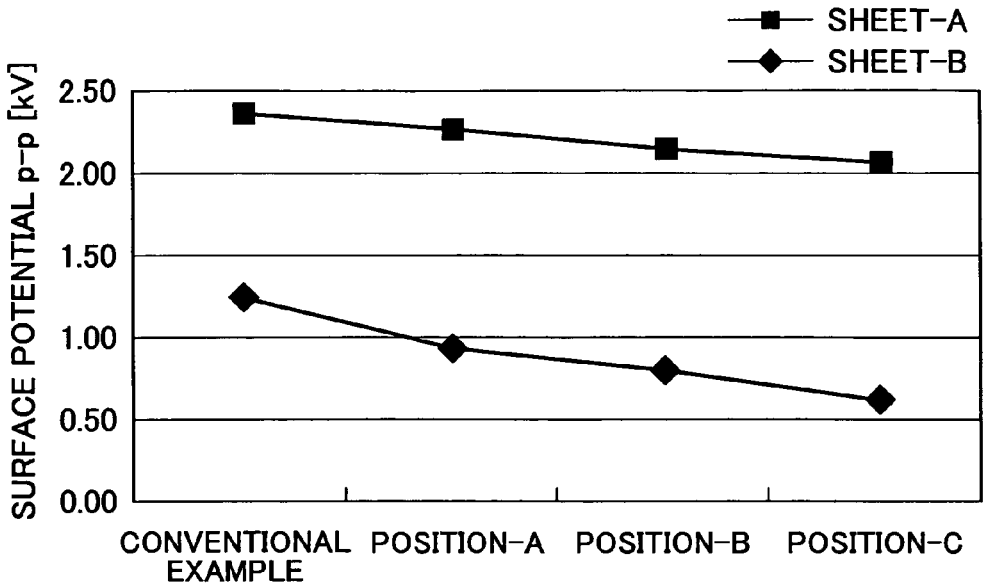
FIG. 11 is a diagram for explaining the relation between the charge elimination effect and the charge eliminating brush arrangement position.

The charge elimination effect of the charge eliminating brush in each position of A, B, and C shown in FIG. 10 is detected using the two sheets with which resistance differs. The result of measurement is shown in FIG. 11. The surface resistivity of the sheet-A is $1.8\times10^{13}$ [Ω/□], and the surface resistivity of the sheet-B is $1.2\times10^{12}$ [Ω/□].

Moreover, the conventional example in FIG. 11 denotes the surface potential of the sheet in the case of printing without using the charge eliminating brush. Moreover, the measurement of surface potential is performed in the position in which the head is located.

As shown in FIG. 11, regardless of the kind of the recording sheet, it is found that the charge eliminating brush nearer to the position of the head has a higher charge elimination effect.

The charge inside the sheet does not yet appear enough on the sheet surface by the electric field at the time the sheet is just attached to the conveyance belt 12. For this reason, it is conceivable that the charge eliminating brush A arranged in the position of A where the brush A contacts the sheet at the time the sheet is just attached to the conveyance belt 12 is not able to acquire sufficient charge elimination effect.

Moreover, as the sheet meets the curvature of the conveyance roller, after it moves to it, the charge eliminating brush B arranged in the position of B in contact with the sheet has sufficient charge elimination effect compared with the charge eliminating brush A.

Since it is long compared with the position of A and the charge in the sheet occurred on the surface, the time when the sheet attached this to the conveyance belt 12 is considered that the charge elimination effect increased.

Moreover, as for the charge, movement is promoted by energy, such as vibration and the heat. While moving to the position of B from the position of A, the sheet deforms the sheet in order to move along with the curvature of the conveyance roller.

Movement of the charge is promoted by deformation of such a recording sheet, the charge generated to the surface increases, and the charge elimination effect in the direction of the charge eliminating brush B of the position of B increased compared with the charge eliminating brush A of the position of A.

Moreover, the charge eliminating brush C in the position of C has the high charge elimination effect compared with the charge eliminating brush B. Since the sheet attached this to the conveyance belt 12 and the time passes, many of charges in the sheet occur on the surface, and it is considered that the charge elimination effect increased.

Moreover, by the heat emitted from the drive motor to which carriage is moved, the heat of the circuit, etc., as a result of promoting movement of the charge in the sheet, many of charges in the sheet occur on the surface, and it is considered that the charge elimination effect of the charge eliminating brush C in the position of C increased.

The above-mentioned experiment shows that, as for the charge eliminating brush 129, the direction prepared near the head can heighten the charge elimination effect.

However, if the charge eliminating brush 129 is provided near the head, in case the conveyance belt 12 will be reverse-rotated at the time of the double-sided print and the sheet will be conveyed in the sheet reversing unit 30, the printing side of the sheet may not get dry enough and the printing side may be soiled with the charge eliminating brush 129.

To obviate the problem when the charge eliminating brush 129 is arranged near the head, the separating mechanism 51 is provided which performs the separation which makes the charge eliminating brush separate from the sheet if the reverse rotation of the conveyance belt 12 is performed.

Figure 12A:
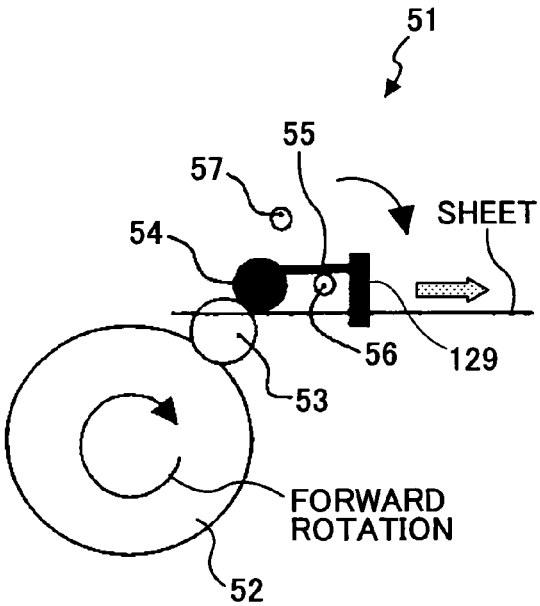
FIG. 12A and FIG. 12B are diagrams for explaining operation of the separation mechanism.
Figure 12B:
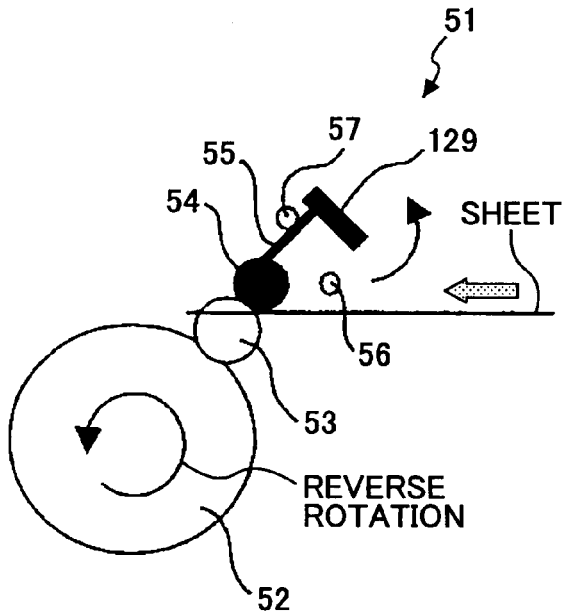

FIG. 12A and FIG. 12B are diagrams for explaining the operation of the separating mechanism 51. FIG. 12A shows the state of the separating mechanism 51 when the forward rotation of the conveyance roller 10 is performed. FIG. 12B shows the state of the separating mechanism 51 when the reverse rotation of the conveyance roller 10 is performed.

As shown in FIG. 12A, the 1st gear 52 is attached to the end of the conveyance roller 10. The 2nd gear 53 is engaged with the 1st gear 52. The 3rd gear 54 is engaged with the 2nd gear 53. The charge eliminating brush 129 is attached to the 3rd gear 54 through the bar 55.

Moreover, the separating mechanism 51 comprises the 1st contact unit 56 which contacts the bar 55 at the time of forward rotation of the conveyance roller 10, and the 2nd contact unit 57 which contacts the bar 55 at the time of reverse rotation of the conveyance roller 10.

As shown in FIG. 12A, at the time of forward rotation of the conveyance roller 10, the rotation driving force of the conveyance roller 10 is transmitted to the 3rd gear 54 through the 1st gear 52 and the 2nd gear 53.

Then, the charge eliminating brush 129 is rotated clockwise as in FIG. 12A. The bar 55 contacts the 1st contact unit 56. Thereby, it is prevented that the charge eliminating brush 129 moves to the sheet side beyond necessity.

If the charge eliminating brush 129 will not move the bar 55 in contact with the 1st contact unit 56, torque will start each gear.

Then, the clutch which is not illustrated is cut and the rotation driving force of the conveyance roller 10 is no longer transmitted to the charge eliminating brush 129.

If the conveyance roller 10 reverse-rotates in order to send the sheet to the sheet reversing unit 30, the clutch which is not illustrated will be connected and the driving force of the conveyance roller 10 will be transmitted to the charge eliminating brush 129 through each gear.

Then, as shown in FIG. 12B, the charge eliminating brush 129 is rotated anti-clockwise and it is separated from the sheet. And it is made for the charge eliminating brush 129 not to move the bar 55 in contact with the 2nd contact unit 57 beyond necessity.

If the charge eliminating brush 129 will not move the bar 55 in contact with the 2nd contact unit 57, torque will start the gear. Then, the stopper unit which is not illustrated operates and the charge eliminating brush 129 is maintained in the position shown in FIG. 12B.

The clutch (not illustrated) is disengaged simultaneously and the driving force of the conveyance roller 10 is made not to be transmitted to the charge eliminating brush 129.

And the sheet is sent to the sheet reversing unit 30 and operation of the stopper unit which will not be illustrated if it right-rotates which is the conveyance roller 10 is canceled.

The clutch which is not illustrated is connected simultaneously and the driving force of the conveyance roller is transmitted to the charge eliminating brush 129 through each gear. At this time, the charge eliminating brush 129 moves, the 1st contact unit 56 is contacted, and the charge eliminating brush 129 contacts the sheet.

In order to send the sheet to the sheet reversing unit 30, when the conveyance roller 10 is reverse-rotated and the sheet is pulled back by this, the charge eliminating brush 129 is separated from the sheet. Consequently, the printing unit of the sheet is not soiled with the charge eliminating brush 129.

Next, the charge eliminator in another preferred embodiment of the invention will be explained. In the present embodiment, the charge eliminator is provided with the charge eliminating brush 129 and a bias voltage of the polarity opposite to the charging polarity on the conveyance belt is supplied to the charge eliminating brush 129, so that the charge on the printing side of the sheet is eliminated.

Figure 13:
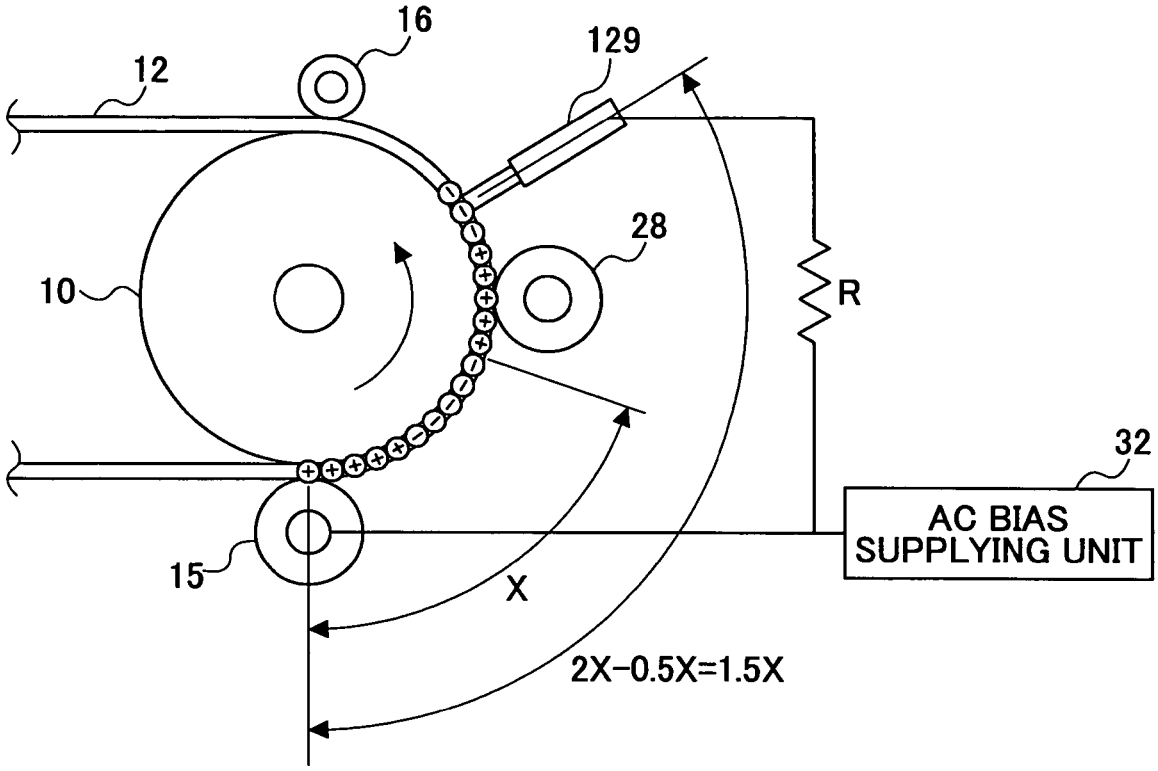
FIG. 13 is a diagram showing the composition in which the bias voltage is supplied to the charge eliminating brush in another preferred embodiment of the invention.

FIG. 13 shows the composition in which the bias voltage is supplied to the charge eliminating brush 129 in this embodiment.

If the charging period length X is defined to be a distance from the positively charged portion of the belt 12 to the negatively charged portion of the belt 12 as shown in FIG. 13, the charge eliminating brush 129 is arranged along the periphery of the conveyance belt 12 at the position that is distant by 1.5X (=2X−0.5X) from the position of the charging roller 15. The position of the charge eliminating brush 129 along the periphery of the conveyance belt 12 is shifted by (½)X from the position of the charging period length X.

Moreover, the charge eliminating brush 129 is connected through the resistor R to the AC bias supplying unit 32 which in turn supplies the voltage to the charging roller 15. The voltage applied to the charge eliminating brush 129 is reduced to about ½ of the voltage applied to the charging roller 15 by the resistor R between the Ac bias supplying unit 32 and the charge eliminating brush 129.

Since the charge eliminating brush 129 and the charging roller 15 are connected to the same voltage supplying unit, the bias voltage of the same polarity is supplied to the charge eliminating brush 129 and the charging roller 15 at the same timing, respectively.

As mentioned above, the charge eliminating brush 129 is arranged along the periphery of the conduction belt 12 at the position 1.5X distant from the position of the charging roller 15, and the position is shifted by (½)X from the position of the charging period length X. Therefore, if the bias voltage of the same polarity is supplied to the charge eliminating brush 129 and the charging roller 15 at the same timing, it is possible to make the polarity of the charge on the charge eliminating brush 129 opposite to the charging polarity on the position of the conveyance belt 12 which confronts the charge eliminating brush 129 at this time.

As shown in FIG. 4B, the charging polarity on the conveyance belt 12 and the polarity of the actual charge on the printing side of the sheet are the same. For this reason, if the bias voltage of the polarity which is the reverse of the charging polarity on the position of the conveyance belt 12 which confronts the charge eliminating brush 129 is supplied to the charge eliminating brush 129, the charge on the printing side of the sheet and the bias supplied to the charge eliminating brush 129 are canceled by each other, and the charge on the printing side of the sheet can be eliminated.

Moreover, since the potential of the printing side of the sheet is smaller than the potential of the conveyance belt 12, if the bias voltage supplied to the charge eliminating brush 129 is the same as the voltage supplied to the charging roller 15, the printing side of the sheet may be charged with the charge eliminating brush 129.

However, in the present embodiment, the bias voltage supplied to the charge eliminating brush 129 is reduced to about ½ of the voltage supplied to the charging roller 15. For this reason, the actual charge on the printing side of the sheet can be eliminated without charging the sheet printing side with the charge eliminating brush 129.

Moreover, the position of the charge eliminating brush 129 arranged along the periphery of the conveyance belt 12 which is distant from the position of the charging roller 15 is shifted by (½)X from an integral multiple of the charging period length X. The same AC bias supplying unit can be used to supply the voltage to the charging roller and the charge eliminating brush. It is possible to decrease the space and the cost of the image forming apparatus.

Moreover, it is not necessary to perform the voltage control to suit the above-mentioned charging period length. It is possible to suppress the use of the complicated control and the complicated device composition as in the conventional technology.

Although the charge eliminating brush 129 of this embodiment is provided at the position where the charge eliminating brush 129 confronts the conveyance roller 10 as shown in FIG. 13, the present invention is not limited to this embodiment. For example, if the charge eliminating brush 129 is provided at the position near the head, the charge elimination effect can be heightened.

Next, the charge eliminator in another preferred embodiment of the invention will be explained. In the charge eliminating brush 29 of the present embodiment, the bias voltage of the polarity which is the reverse of the charging polarity on the conveyance belt is supplied to the pressure roller 16 or the guide roller 28, and the charge on the printing side of the sheet is eliminated as a charge eliminator as shown in FIG. 14A.

Figure 14A:
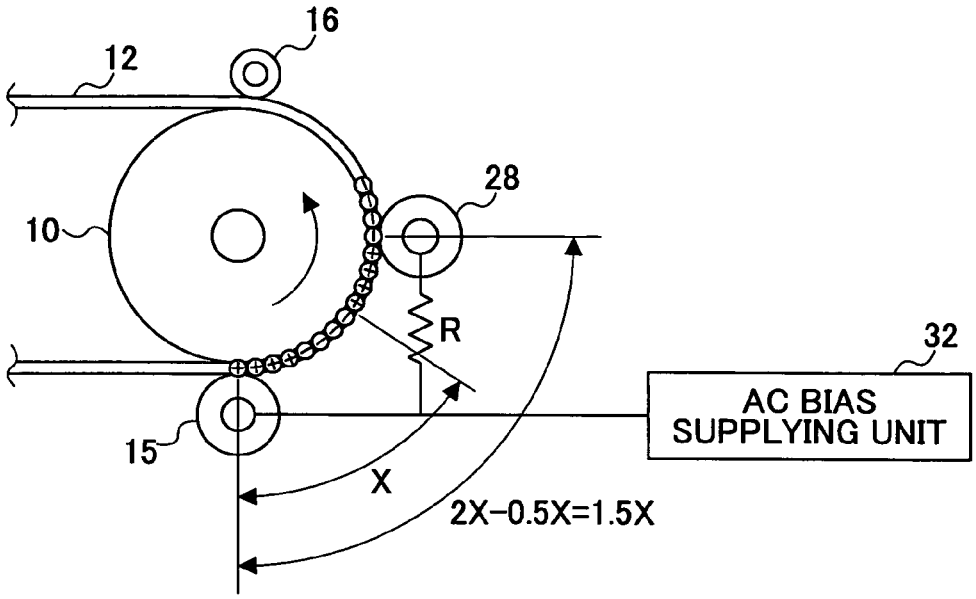
FIG. 14A is a diagram showing the composition in which the guide roller is used as the charge eliminating roller.
Figure 14B:
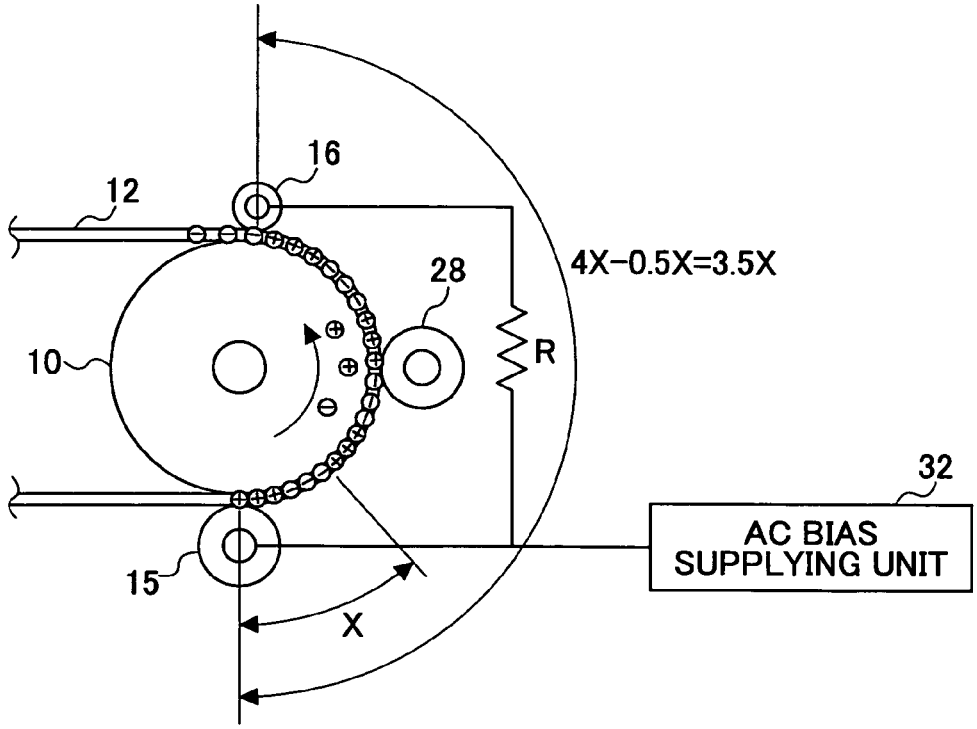
FIG. 14B is a diagram showing the composition in which the pressure roller is used as the charge eliminating roller.

FIG. 14A shows the composition in which the guide roller 28 is used as the charge eliminating roller 29. FIG. 14B shows the composition in which the pressure roller 16 is used as the charge eliminating roller 29.

In the charge eliminating roller 29 of FIG. 14A, when the charging period length is set to X, the position of the charge eliminating roller 29 (or the guide roller 28) arranged along the periphery of the conveyance belt 12 distant from the position of the charging roller 15 is set to 1.5X, and it is shifted by (½)X from the position of the integral multiple of the charging period length X.

Moreover, in the charge eliminating roller 29 of FIG. 14B, the position of the charge eliminating roller 29 (or the pressure roller 16) arranged along the periphery of the conveyance belt 12 distant from the position of the charging roller 15 is set to 3.5X, and it is shifted by (½)X from the position of the integral multiple of the charging period length X.

Moreover, the charge eliminating roller 29 shown in FIG. 14A or FIG. 14B is connected to the same AC bias supplying unit 32 as the charging roller 15 through Resistance R. The voltage applied to the charge eliminating roller 29 can be reduced to about ½ of the voltage applied to the charging roller 15 by the resistor R. The charge eliminating roller 29 and the charging roller 15 are connected to the same power supply.

The same polar bias is applied to the charge eliminating roller 29 and the charging roller 15 to the same timing, respectively. The position of the charge eliminating roller 29 is shifted by (½) of the charging period length X. Therefore, if the same polar bias is applied to the charge eliminating roller 29 to the same timing as the charging roller 15, the bias of the charge eliminating roller 29, the charging polarity on the conveyance belt which confronts, and reversed polarity will be applied to the charge eliminating roller 29.

In the sheet printing side, the same polar charge as the charging polarity on the conveyance belt 12 occurs. By applying the bias of the charging polarity on the conveyance belt 12, and reversed polarity to the charge eliminating roller 29, the charge by the side of the sheet printing side can be negated.

Figure 15:
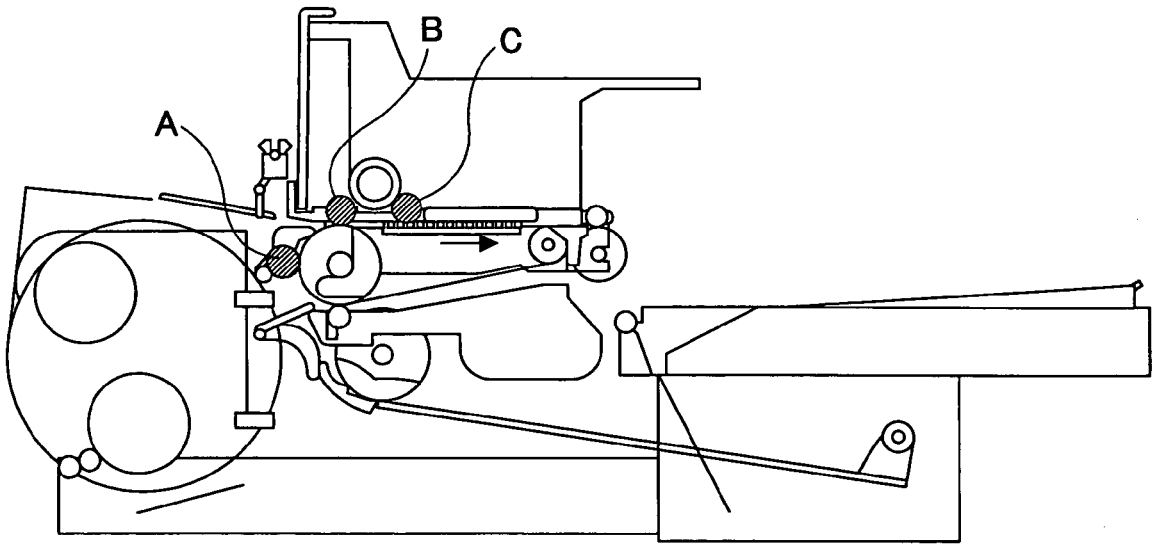
FIG. 15 is a diagram showing the arrangement positions of the charge eliminating roller.

Next, it is detected about the arrangement position of the charge eliminating roller 29. FIG. 15 shows the arrangement positions of the charge eliminating roller. In FIG. 15, A, B, and C denote the arrangement positions of the charge eliminating roller 29.

The charge elimination effect of the charge eliminating roller 29 in each position of A, B, and C shown in FIG. 15 is detected using the two sheets A and B with which resistance differs. The surface resistivity of the sheet-A is $1.8\times10^{3}$ [Ω/□], and the surface resistivity of the sheet-B is $1.2\times10^{12}$ [Ω/□].

Figure 16:
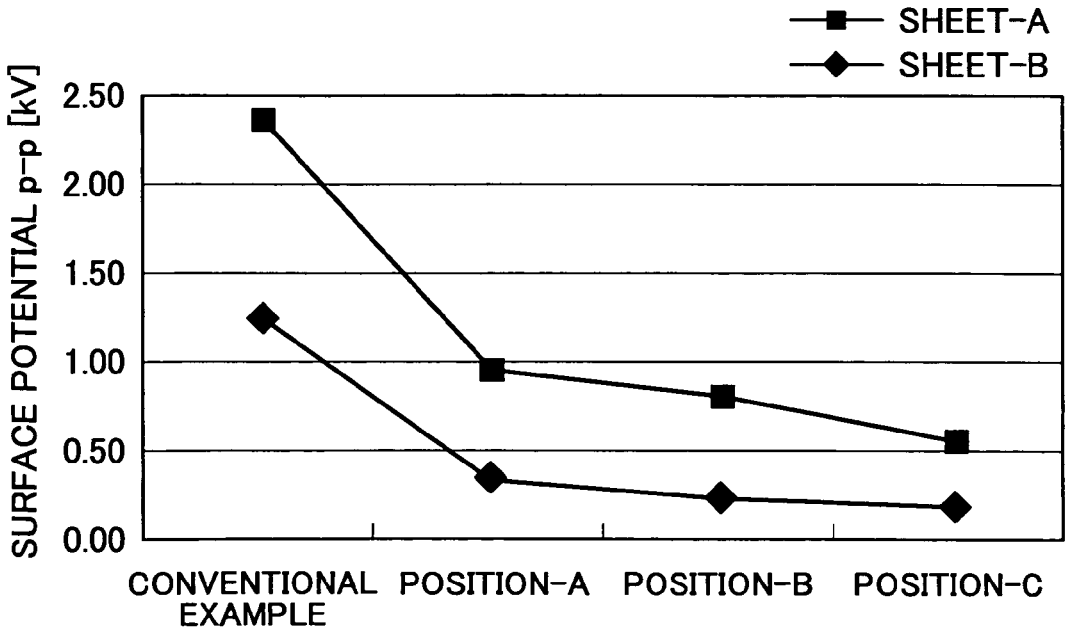
FIG. 16 is a diagram for explaining the relation between the charge elimination effect and the charge eliminating roller arrangement position.

FIG. 16 shows the measurement result of the charge elimination effect of the charge eliminating roller 29.

The conditions shown in FIG. 16 are the surface potential of the sheet when the charge eliminating roller is not provided. Moreover, measurement of surface potential is performed in the position in which the head is located.

As shown in FIG. 16, also in the charge eliminating roller 29, the charge elimination effect in the direction of the charge eliminating rollers B and C arranged in the positions B and C after the sheet moves along with the curvature of the conveyance roller 10 is high compared with the charge elimination effect of the charge eliminating roller A arranged like the charge eliminating brush in the position A before the sheet moves along with the curvature of the conveyance roller 10.

Similar to the charge eliminating brush, as a result of the sheet movement along with the curvature of the conveyance roller 10, movement of the charge in the sheet is promoted, and this is considered because the charge on the surface of the sheet is removed, after many charges occur on the sheet surface.

Thus, if the charge eliminating roller 29 is arranged near the head, the charge elimination effect will be increased. However, similar to the charge eliminating brush 129, the charge eliminating roller 29 may stain the printing side of the sheet at the time of the double-sided printing.

As for the charge eliminating roller 29, the separating mechanism which is the same as in the charge eliminating brush and separates the charge eliminating roller 29 from the sheet when the sheet is conveyed to the sheet reversing unit 30 is also provided.

Namely, the charge eliminating brush 129 attached to the bar 55 of the separating mechanism 51 of FIG. 12A is replaced with the charge eliminating roller 29. By this composition, when the sheet is conveyed to the sheet reversing unit 30, the charge eliminating roller 29 is separated from the sheet. Therefore, the printing side of the sheet is not stained.

A description will be given of another preferred embodiment of the invention.

In the above-mentioned printer, the conveyance belt 12 is suspended while the image is printed on the sheet. If the supplying of the AC bias to the charging roller 15 or the charge eliminator 29 is continued when it is in the state which the conveyance belt 12 is stopped, the deviation of the charging period length may arise.

Figure 17:
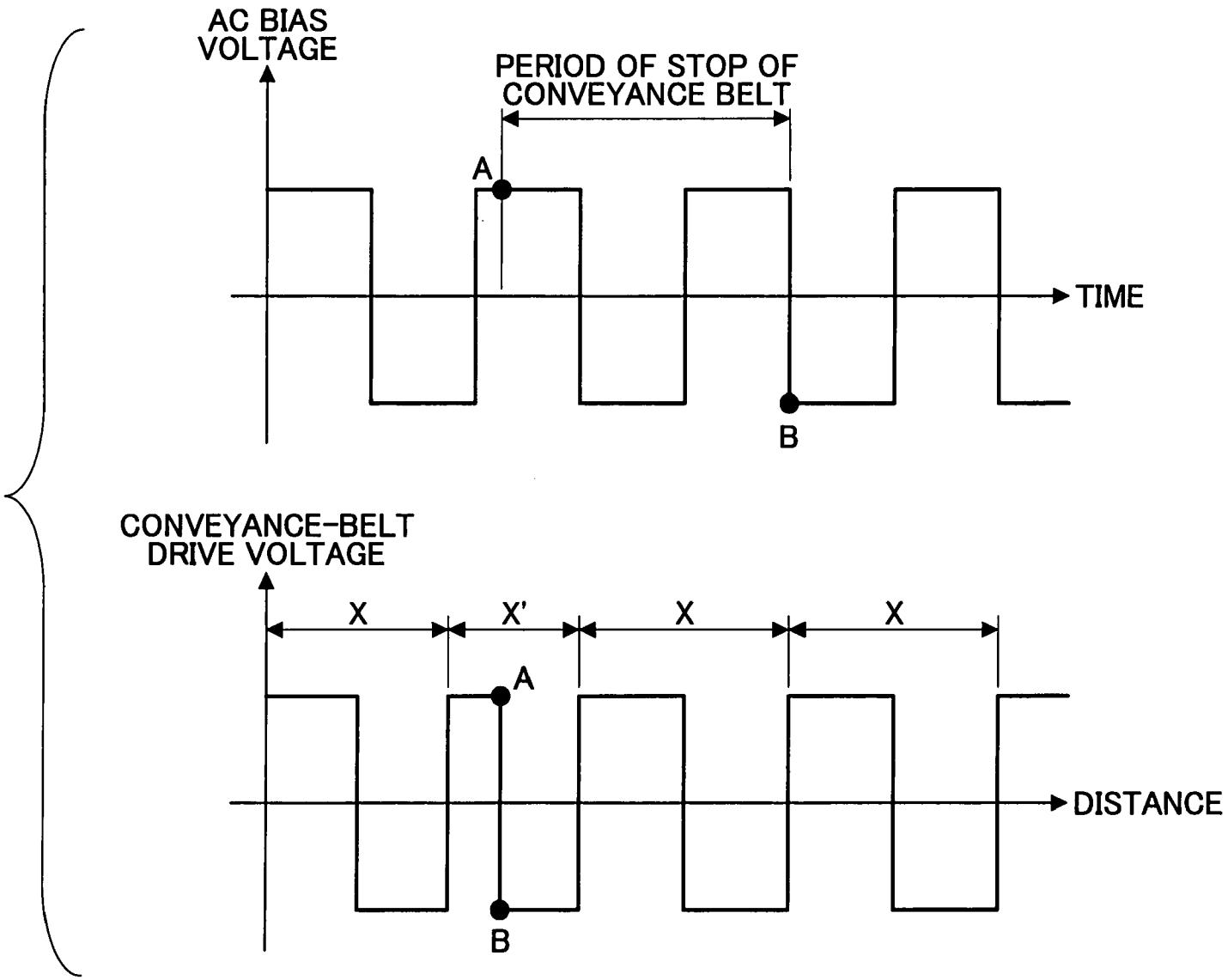
FIG. 17 is a diagram for explaining the problem in which the charging period length becomes short.

Namely, as shown in FIG. 17, depending on the timing at which the movement of the conveyance belt 12 is restarted, the charging period length X is short and the long partial X' will arise.

Consequently, the polarity of the conveyance belt and the AC bias applied to the sheet may be unable to remove the charge on the deviation and the surface of the sheet from the charge eliminator 29.

Moreover, since the voltage is continued and applied to the same portion of the sheet from the charge eliminator 29 while the conveyance belt 12 stops, the charge may be conversely supplied to the sheet from the charge eliminator 29.

Moreover, since the voltage is continued and applied to the same portion of the conveyance belt 12 from the charging roller 15, the conveyance belt 12 may generate heat. Thus, when the conveyance belt 12 generated heat, there is the case where induced the pinhole and it developed into leak.

Figure 18:
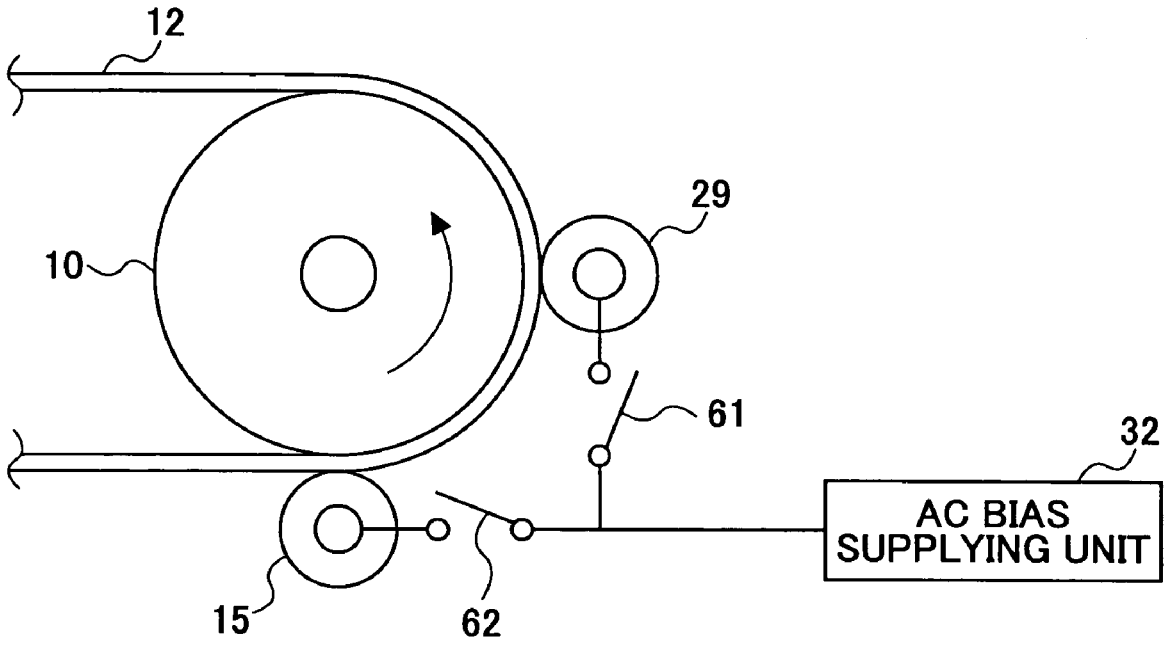
FIG. 18 is a diagram showing the composition of the charge eliminating roller in one preferred embodiment of the invention.

Then, in the present embodiment, as shown in FIG. 18, when the switches 61 and 62 are provided, respectively between the charge eliminator 29, the AC bias supplying unit 32, and the charging roller 15 and the AC bias supplying unit 32 and the conveyance belt 12 stops, each switches 61 and 62 are turned OFF.

Figure 19:
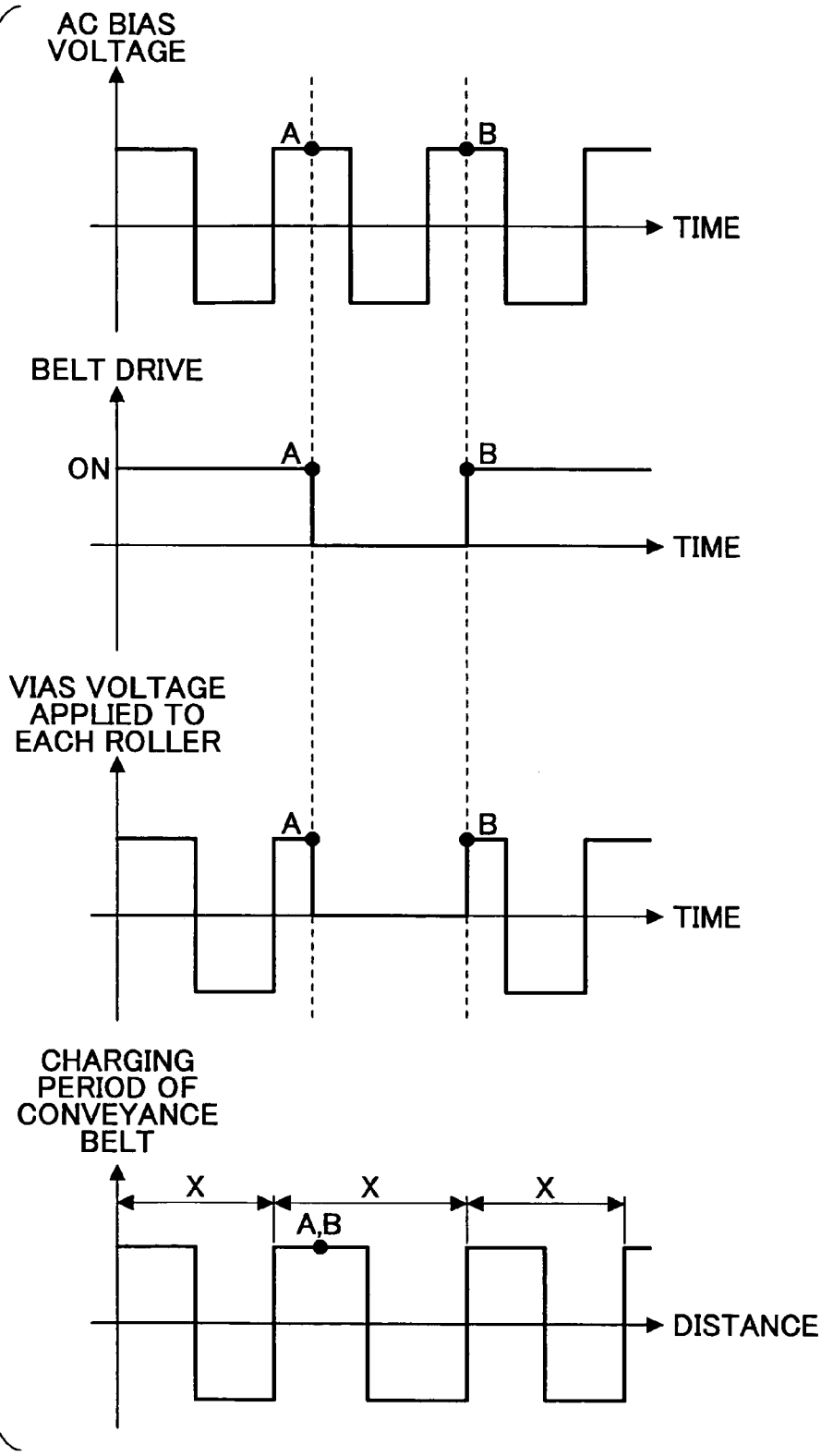
FIG. 19 is a diagram showing the ON/OFF timing of the switches.

FIG. 19 shows the ON/OFF timing of the switches.

As shown in FIG. 19, the movement of the conveyance belt 12 is stopped (A of FIG. 19), and each of the switches 61 and 62 is turned OFF and the supplying of the AC bias to the charging roller 15 and AC bias to the charge eliminator 29 is stopped.

The polarity of the voltage currently applied to the charging roller at this time and the charge eliminator and the voltage applying time of this polar voltage are stored.

And when the polarity of voltage and voltage applying time which the AC bias supplying unit 32 stored come (B of FIG. 19), each switches 61 and 62 are turned ON, and AC bias is supplied to the charging roller 15 and the charge eliminator 29.

Simultaneously with this, the movement of the conveyance belt is restarted. Thereby, as shown in FIG. 19, the deviation of the charging periodicity of the conveyance belt does not arise.

Figure 20:
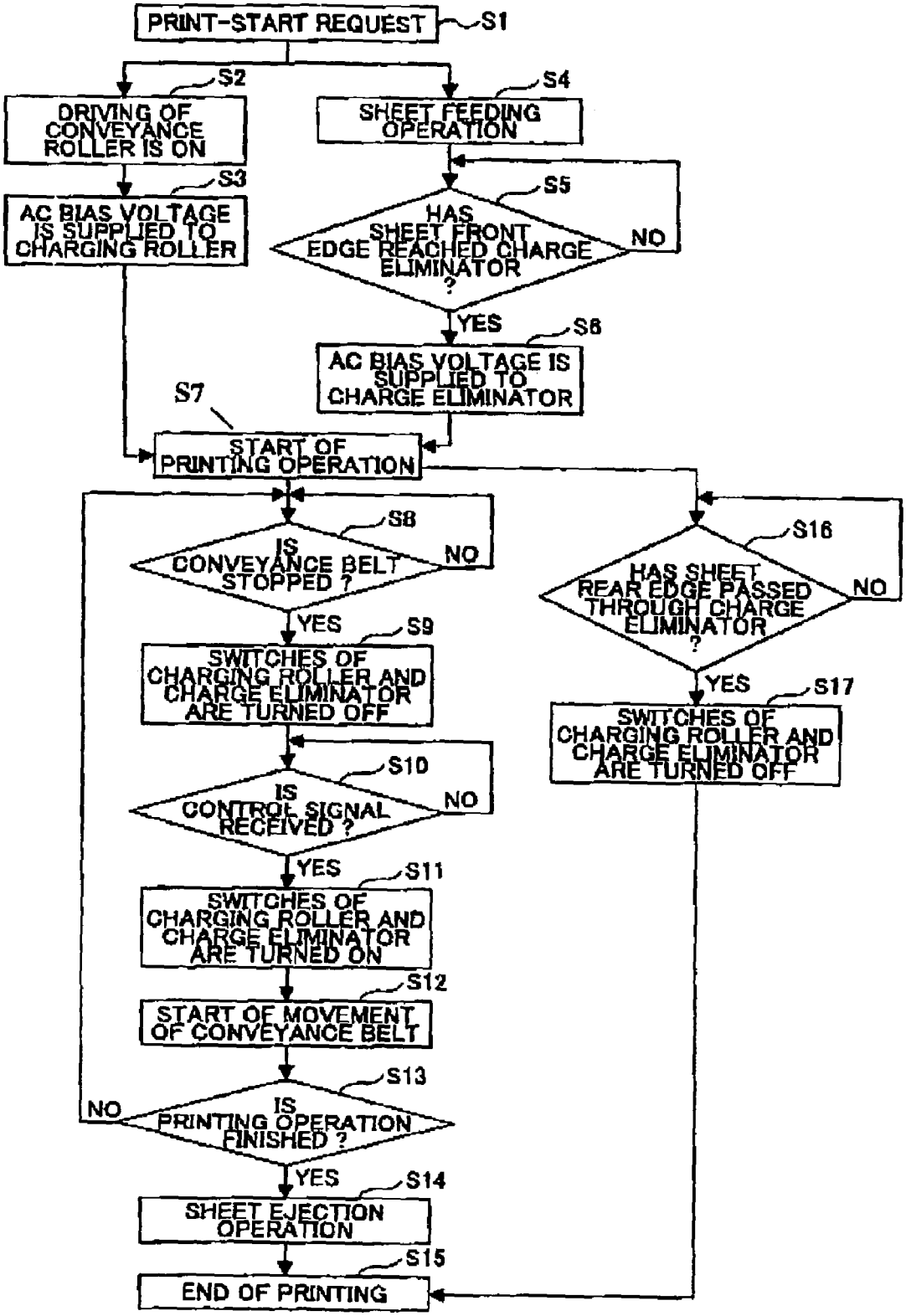
FIG. 20 is a flowchart for explaining the control procedure for controlling the ON/OFF timing of the switches.
Figure 21:
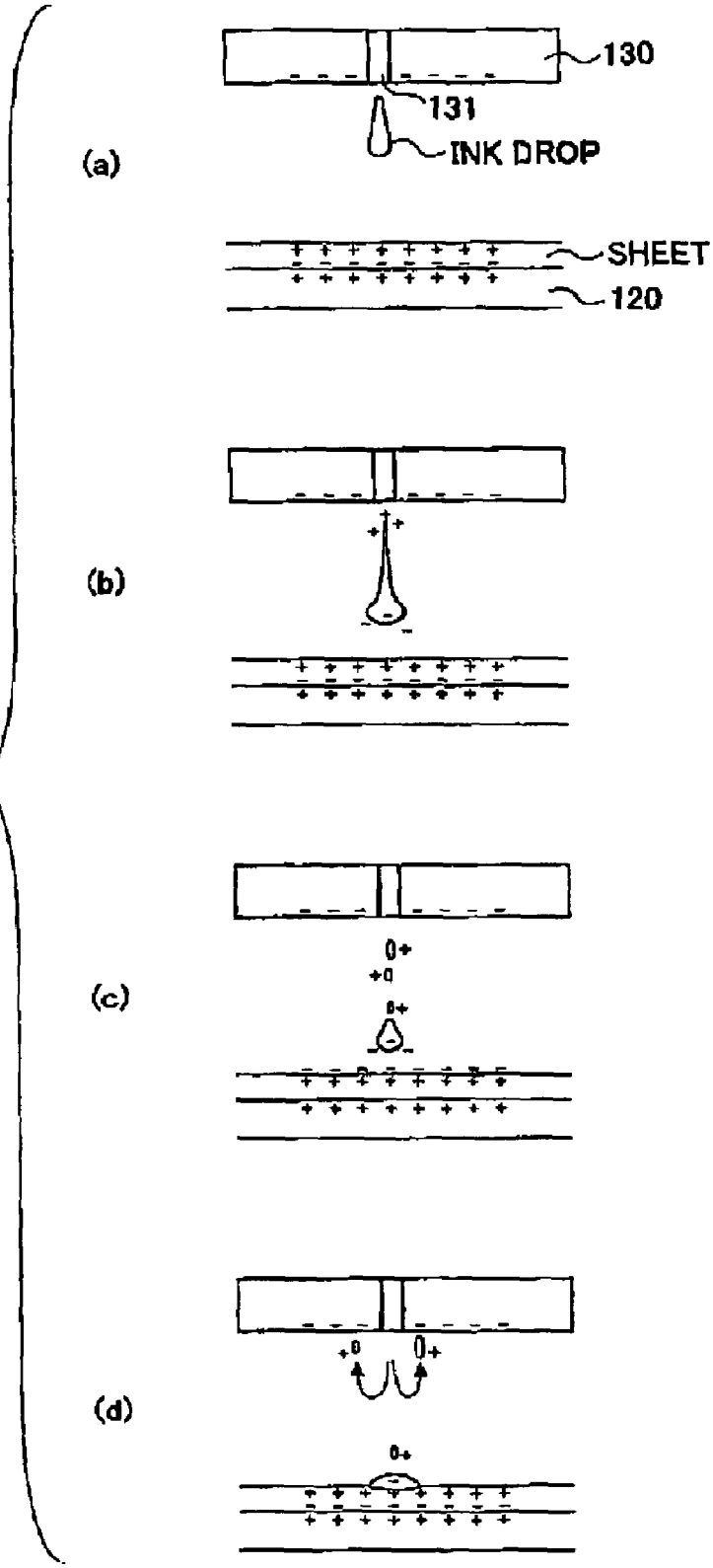
FIG.21 Prior Art
FIG. 21 is a diagram for explaining the conventional image forming method.

FIG. 20 is a flowchart for explaining the control procedure which controls the timing of the switches 61 and 62.

As shown in FIG. 20, first, the image signal is inputted to the printer from the personal computer etc., and printing is started (S1).

When the printing is started, the drive switch of the conveyance roller 10 is turned ON and the conveyance roller is driven (S2). The conveyance belt 12 wound around the conveyance roller and the tension roller is rotated as a result of the driving of the conveyance roller 10.

Next, the switch 62 between the AC bias supplying unit 32 and the charging roller 15 is turned ON, and the AC bias voltage is supplied to the charging roller 15 (S3).

On the other hand, when the printing is started, the sheet feeding operation is performed and the sheet is conveyed from the sheet feeding tray 18 to the conveyance belt 12 (S4). And it is detected whether the sheet front edge has reached the charge eliminator 29 (S5).

When the sheet front edge reaches the charge eliminator 29 (YES of S5), the switch 61 between the charge eliminator 29 and the AC bias supplying unit 32 is turned ON, and the AC bias voltage is supplied to the charge eliminator 29 (S6).

And the printing operation is started when the sheet front edge is conveyed to the position which the sheet confronts the head 13 (S7). Specifically, in this step, the movement of the conveyance belt 12 is stopped, the carriage 9 is moved in the direction of the main scanning line, and the image for one line is printed on the sheet.

After the printing operation is started, it is detected whether the conveyance belt 12 is stopped (S8).

When the movement of the conveyance belt 12 is stopped (YES of S8), each of the switches 61 and 62 of the charging roller 15 and the charge eliminator 29 is turned OFF (S9), so that the AC bias voltage is no longer supplied.

Moreover, in the step S9, the polarity of the voltage currently supplied to the charging roller 15 and the charge eliminator 29 and the voltage applying time of the voltage of that polarity are temporarily stored in the memory immediately before the switches are turned OFF.

Next, after printing of the image for one line on the sheet is finished, it is detected whether a control signal to move the conveyance belt is received (S10).

When the signal to move the conveyance belt is a received (YES of S10), the switches 61 and 62 of the charging roller 15 and the charge eliminator 29 are turned ON at the time such that the AC bias voltage being supplied has the polarity and the voltage applying time which are the same as those stored in the memory (S11).

The movement of the conveyance belt 12 is restarted simultaneously with the time the AC bias voltage is supplied to the charging roller 15 and the charge eliminator 29 (S12).

Next, it is detected whether the printing operation for the entire image is finished (S13). When there is the remaining image for the following lines to be printed (NO of S13), the control is transferred to the above step S8 and the same procedure is repeated.

On the other hand, when the printing operation is finished and there is no image to be printed (YES of S13), the sheet ejection operation is performed (S14). Then, the printing of the entire image on the sheet is completed (S15).

Moreover, when the printing operation is started at the step S7, it is detected whether the sheet rear edge passes through the charge eliminator 29 (S16).

When the sheet rear edge passes through the charge eliminator 29 (YES of S16), the switches 61 and 62 of the charging roller 15 and the charge eliminator 29 are turned OFF (S17), and the printing is completed (S15).

Accordingly, the AC bias voltage is not supplied to the charge eliminator 29 and the charging roller 15 when the movement of the conveyance belt 12 is stopped, and the AC bias voltage is not supplied to the same portion continuously.

Thereby, it is possible to prevent that the charge be supplied to the sheet from the charge eliminator 29, or the conveyance belt 12 be heated to induce the pinhole or cause the leakage.

Moreover, in the above-described embodiment, the AC bias voltage polarity and the voltage applying time when the switches 61 and 62 are turned OFF are stored in the memory, and the switches 61 and 62 are turned ON at the time such that the AC bias voltage being supplied by the AC bias supplying unit 32 has the polarity and the voltage applying time which are the same as those stored in the memory. Simultaneously with the turning ON of the switches 61 and 62, the driving of the conveyance belt 12 is restarted. Accordingly, the charging periodicity does not deviate and the charge on the surface of the sheet can be eliminated certainly.

Moreover, each of the switches 61 and 62 is turned ON and it is possible to make it switch off according to the kind of sheet. For example, it will take time until the charge moves to the printing side of the sheet, after the sheet carries out the dielectric polarization by the electric field of the conveyance belt in the case of the high resistance sheet, such as the OHP sheet.

Consequently, the charge of the more than mutually negated on the sheet surface from the charge eliminator is given, and there is the case where the sheet surface is charged conversely.

Moreover, by the time the sheet arrives at the head and the position which confronts, sufficient charge will not move, and the influence of the electric field of the conveyance belt does not become weaker.

Consequently, the charge generated by the dielectric polarization will exist in the printing side of the sheet, and potential will occur in the sheet printing side. Therefore, electric field will occur between the sheet and the head.

Then, each of the switches 61 and 62 is turned ON, OFF is controlled, and it is made for electric field not to occur between the head and the sheet.

The switch 62 of the charging roller is specifically turned OFF to the timing which the OHP sheet is conveyed and carried out for the period of the fixed time, and it is made for the electric field of the conveyance belt to work at the edge of the OHP sheet.

And the switch 62 of the charging roller is turned ON to the timing that the back end of the OHP sheet is earlier than the timing in contact with the conveyance belt, and it is made for the electric field of the conveyance belt to work to the sheet back end.

Consequently, only the edge and the back end of the OHP sheet carry out electrostatic attaching in response to the influence of the electric field of the conveyance belt at the conveyance belt. Thereby, the OHP sheet can be conveyed with high accuracy.

Moreover, the portion on which the image of OHP is recorded does not have the influence of the electric field of the conveyance belt. Therefore, the electric field does not occur in the portion on which the image of the OHP sheet is recorded between the sheet and the head.

Moreover, when the OHP sheet is conveyed, the switch 61 of the charge eliminator is turned OFF, and it controls not to make bias apply to the charge eliminator 29. It is prevented by this that the charge is given to the sheet from the charge eliminator beyond necessity, and it can prevent that the printing side of the sheet is charged by the charge eliminator.

In the above-mentioned preferred embodiment, although the charge eliminators, such as the charge eliminating brush 129 and the charge eliminating roller 29, are prepared in the one place, it is possible to prepare two or more charge eliminators.

Moreover, the pressure roller 16 and the guide roller 28 are printed with the material with the conductivity, it drops on the ground, and it is possible to make it remove the residual charge of the sheet.

Furthermore, heating units, such as the heater, are prepared in the downstream side, and it is possible to make it heat the sheet rather than the charge eliminator to the movement direction of the conveyance belt.

Thus, by heating the sheet, it can promote that the charge inside the sheet moves to the printing side. Therefore, the charge inside the sheet is removable by removing the charge by the side of the printing side by the charge eliminator, after the sheet is heated.

Consequently, after removing the charge by the side of the printing side by the charge eliminator, the quantity of the charge which moves to the printing side from the interior of the sheet can be stopped, it is suppressed that electric field are provided between the head and the sheet, and it can suppress that the ink drop is charged.

As mentioned above, according to the image forming apparatus of the present embodiment, AC bias is applied to the conveyance belt, while decreasing the amount of charges which is generated to the printing side of the sheet, the charge from which positive polarity and negative polarity differ in the printing side of the sheet is made to generate, it denies to each other, and the charge by the side of the sheet printing side is removed.

Furthermore, by the time it arrives at the position where the sheet which carried out electrostatic attaching confronts the conveyance belt with the head, the charge eliminator will remove the charge by the side of the printing side of the sheet.

Even if the conveyance speed increases, it can avoid making the charge by this almost exist in the printing side of the sheet which arrived at the head and the position which confronts. Consequently, it is suppressed that the ink which it is suppressed that electric field occur between the sheet and the head, and it discharged from the head is charged.

Therefore, also in the high-speed printing, the impact position of the ink drop not shifting, and ink mist adhering to the discharge nozzle of the head, and barring the discharge of the normal ink is suppressed. Therefore, the high quality image can be obtained also in the high-speed printing.

Moreover, in the present embodiment, the charge eliminator comprises the conductive members. Thereby, the charge by the side of the sheet printing side is smoothly removable.

Moreover, by using the charge eliminator as the pressure roller, while pushing the sheet against the conveyance belt, the charge of the printing side of the sheet is removable.

Moreover, the charge by the side of the sheet printing side is smoothly removable by using the charge eliminator as the charge eliminating brush as a conductive brush.

Moreover, the negatively charged portion and positively charged portion of the sheet can be covered and contacted by providing the width of the charge eliminating brush larger than (½) of the charging period length X. Thereby, the negative charge and the positive charge can be eliminated with one charge eliminating brush.

Consequently, since the charge is negated within the charge eliminating brush, the charge eliminating brush cannot be charged easily. Therefore, since electric discharge capacity does not decline, the charge by the side of the sheet printing side can be removed still more smoothly.

Moreover, the charge by the side of the printing side of the sheet is removed by applying the bias of the charge eliminator, the charging polarity on the conveyance belt which confronts, and reversed polarity to the charge eliminator.

Negative charge moves to the surface at the printing side of the sheet which confronts the portion in which the conveyance belt carries out negatively charged, and positive charge moves to the surface at the printing side of the sheet which confronts the portion into which the conveyance belt is positively charged.

Therefore, the voltage of the charge eliminator, the polarity of the charge by the side of the printing side of the sheet which confronts, and reversed polarity will be applied to the charge eliminator by applying the bias of the charge eliminator, the charging polarity on the conveyance belt which confronts, and reversed polarity to the charge eliminator.

Consequently, the charge by the side of the printing side of the sheet denies the charge of the charge eliminator, there is, and it can remove the charge by the side of the printing side of the sheet.

Moreover, when the charging period length is set to X, it is made for the movement distance of the conveyance belt from the charging roller to the charge eliminator to serve as X (a−0.5) (where a is an integer).

Thereby, the movement distance of the conveyance belt from the charging roller to the charge eliminator shifts from the integral multiple of the charging period length the semicircle term.

Then, if the same polar bias is applied to the charge eliminator to the same timing as the charging roller, the charge eliminating brush, the charging polarity on the conveyance belt in the position which confronts, and the polarity applied to the charge eliminating brush can be changed at this time.

Therefore, the AC bias supplying unit which is the same voltage applying unit about the charging roller and the charge eliminator can be used. The space saving of the image forming device and the cost reduction can be attained.

Moreover, it is not necessary to control voltage to suit the above-mentioned charging periodicity. Thereby, the complication of control and the complication of the device can be suppressed.

Moreover, while the conveyance belt is stopping, it is made not to apply voltage to the charging roller and the charge eliminator. Thereby, voltage is not applied to the same portion of the conveyance belt from the charging roller. Thus, the conveyance belt generates heat, the pinhole is induced, and it develops into leak, and does not wait.

Moreover, since voltage is not applied from the charge eliminator succeeding the same portion of the sheet, it can prevent the charge being supplied to the sheet from the charge eliminator 29, and charging the printing side of the sheet.

Moreover, the sheet—high resistance of OHP etc.—in the case of the member, it controls not to make bias apply to the charge eliminator. It is prevented by this that the charge is given to the sheet from the charge eliminator beyond necessity, and it can prevent that the printing side of the sheet is charged by the charge eliminator.

Moreover, the switch of the charging roller is controlled and it is made to make the conveyance belt carry out electrostatic attaching only of the edge and the back end of the OHP sheet. The conveyance belt can be made to carry out electrostatic attaching of the OHP sheet. The OHP sheet can be conveyed with high accuracy.

Moreover, the charge is not given to the conveyance belt at the conveyance belt which confronts the portion on which the image of the OHP sheet is recorded. Thereby, the portion on which the image of the OHP sheet is recorded is not influenced of the electric field of the conveyance belt, and the charge is not generated by electrostatic polarization at the printing side of the sheet. Consequently, electric field do not occur between the head and the sheet and the portion on which the image of the OHP sheet is recorded can obtain the good image.

Thus, the sheet which cannot weaken influence of the electric field of the conveyance belt by the time it is hard to move the charge by high resistance of OHP etc. and confronts with the head can also convey the sheet with high accuracy, and can obtain the high quality image.

Moreover, after the sheet carries out electrostatic attaching and moves to the conveyance belt along with the curvature of the conveyance roller 10, the charge eliminator removes the charge by the side of the printing side of the sheet. If the sheet carries out electrostatic attaching at the conveyance belt, polarization of the sheet will be carried out by the electric field of the conveyance belt.

Consequently, the charge the charging polar of the conveyance belt and polar this moves, and the polar charge opposite to the charging polarity of the conveyance belt moves to the printing side of the sheet at the conveyance belt side of the sheet.

However, it takes time that the charge in the interior of the sheet moves to the printing side. For this reason, after removing the charge by the side of the printing side by the charge eliminator, the charge inside the sheet may move to the printing side.

Consequently, in spite of having removed the charge by the side of the printing side by the charge eliminator, there is the case where the charge existed in the printing side of the sheet conveyed in the head and the position which confronts.

On the other hand, movement of the charge inside the sheet promotes because the sheet moves along with the curvature of the conveyance roller. Consequently, after the sheet moves along with the curvature of the conveyance roller, the charge inside the sheet moves to the printing side.

Therefore, the charge inside the sheet is also removable by removing the charge by the side of the printing side by the charge eliminator, after the sheet moves along with the curvature of the conveyance roller.

Consequently, after removing the charge by the side of the printing side by the charge eliminator, the quantity of the charge which moves to the printing side from the interior of the sheet can be stopped.

Therefore, the charge hardly exists in the printing side of the sheet conveyed in the head and the position which confronts. It is suppressed by this that electric field are provided between the head and the sheet, and it can suppress certainly that the ink drop is charged.

Moreover, by preparing the charge eliminator near the head, the sheet can lengthen time to adsorb to the conveyance belt 12 until the charge on the surface of the sheet is removed by the charge eliminator.

Consequently, by the time it reaches the charge eliminator, many charges on the sheet surface in the sheet can be generated, and the charge elimination effect can be heightened.

Moreover, the separating mechanism which makes the charge eliminator separate from the sheet when the reverse-rotation of the conveyance belt is performed, in order to make the sheet reversing unit 30 convey the sheet. Thereby, it is lost that the printing unit of the sheet is soiled by the charge eliminator.

Moreover, in the movement direction of the conveyance belt, the upstream side comprises the heating member rather than the charge eliminator. Thereby, before the sheet reaches the charge eliminator, by the heating member, movement of the charge inside the sheet can be promoted and the charge inside the sheet can be moved to the printing side.

Consequently, the charge inside the sheet is also removable by the charge eliminator. Therefore, almost no charge exists on the printing side of the sheet which is conveyed to the position where the sheet confronts the head. It is possible to suppress the forming of the electric field between the head and the sheet, and it is possible to suppress certainly that the ink drop is charged.

The present invention is not limited to the above-described embodiments and variations and modifications may be made without departing from the scope of the invention.

The invention claimed is:

1. An image forming apparatus, comprising:

a head unit having a discharge nozzle for discharging an ink wherein the head unit discharges the ink from the discharge nozzle to print an image on a recording sheet;

a conveyance unit confronting the head unit and conveying the sheet in a movement direction to a position where the sheet confronts the head unit, the conveyance unit comprises a conveyance belt wound around at least two rollers;

a charging unit provided in the conveyance unit and configured to receive a first AC bias voltage and apply a charge, based on the first AC bias voltage, to a surface of the conveyance belt;

a charge eliminating unit configured to receive a second AC bias voltage and eliminate charge of a printing surface of the recording sheet, the charge eliminating unit being disposed at a position on a downstream side of the charging unit in the movement direction of the conveyance unit and on an upstream side of the head unit; and an AC bias supplying unit configured to supply said first and second AC bias voltages at selected timings;

wherein the charge eliminating unit is disposed on a downstream side of a position where the recording sheet is conveyed along a curvature of each of said at least two rollers by the conveyance belt, in the movement direction of the conveyance unit.

2. The image forming apparatus of claim 1, wherein the charge eliminating unit is disposed at a position near the head unit.

3. The image forming apparatus of claim 2, further comprising:

a sheet reversing unit reversing the recording sheet; and a sheet separating unit separating the charge eliminating unit from the recording sheet when the conveyance unit is reversely rotated to convey the recording sheet after the image is printed on the printing surface of the recording sheet, to the sheet reversing unit.

4. An image forming apparatus, comprising:

a head unit having a discharge nozzle for discharging an ink wherein the head unit discharges the ink from the discharge nozzle to print an image on a recording sheet;

a conveyance unit confronting the head unit and conveying the sheet in a movement direction to a position where the sheet confronts the head unit, the conveyance unit comprises a conveyance belt wound around at least two rollers;

a charging unit provided in the conveyance unit and configured to receive a first AC bias voltage and apply a charge, based on the first AC bias voltage, to a surface of the conveyance belt;

a charge eliminating unit configured to receive a second AC bias voltage and eliminate charge of a printing surface of the recording sheet, the charge eliminating unit being disposed at a position on a downstream side of the charging unit in the movement direction of the conveyance unit and on an upstream side of the head unit; and an AC bias supplying unit configured to supply said first and second AC bias voltages at selected timings, wherein said second AC bias voltage is a voltage of polarity which is opposite to a charging polarity of a conveyance belt of the conveyance unit at a position where the conveyance belt confronts the charge eliminating unit, and wherein a movement distance of the conveyance unit from the charging unit to the charge eliminating unit is represented by a distance that is obtained by subtracting (½)X from an integral multiple of X where X denotes a charging period length equal to a sum of a length of a positively charged portion of the conveyance unit and a length of a negatively charged portion of the conveyance unit.

5. The image forming apparatus of claim 4, further comprising a control unit controlling the voltage supplying unit so that no voltage is supplied to the charging unit and the charge eliminating unit when movement of the conveyance unit is stopped.

6. The image forming apparatus of claim 4, further comprising a control unit controlling the voltage supplying unit to vary the voltage supplied to the charge eliminating unit, depending on a kind of the recording sheet.

7. The image forming apparatus of claim 4, wherein the charge eliminating unit is disposed at a position near the head unit.

8. The image forming apparatus of claim 7, further comprising:

a sheet reversing unit reversing the recording sheet; and a sheet separating unit separating the charge eliminating unit from the recording sheet when the conveyance unit is reversely rotated to convey the recording sheet after the image is printed on the printing surface of the recording sheet, to the sheet reversing unit.

9. The image forming apparatus of claim 4, wherein the charging unit and the charge eliminating unit are connected to the voltage supplying unit, and a bias voltage of same polarity is supplied to the charging unit and the charge eliminating unit at a time, respectively.

10. An image forming apparatus, comprising:

a head unit having a discharge nozzle for discharging an ink wherein the head unit discharges the ink from the discharge nozzle to print an image on a recording sheet;

a conveyance unit confronting the head unit and conveying the sheet in a movement direction to a position where the sheet confronts the head unit, the conveyance unit comprises a conveyance belt wound around at least two rollers;

a charging unit provided in the conveyance unit and configured to receive a first AC bias voltage and apply a charge, based on the first AC bias voltage, to a surface of the conveyance belt;

a charge eliminating unit configured to receive a second AC bias voltage and eliminate charge of a printing surface of the recording sheet, the charge eliminating unit being disposed at a position on a downstream side or the charging unit in the movement direction of the conveyance unit and on an of the head unit;

an AC bias supplying unit configured to supply said first and second AC bias voltages at selected timings; and a heating unit heating the recording sheet, the heating unit being disposed at a position on an upstream side of the charge eliminating unit in the movement direction of the conveyance unit.

11. The image forming apparatus of claim 4, wherein the charging period length is less than or equal to 40 mm.

12. The image forming apparatus of claim 4, wherein said second AC bias voltage supplied to said charge eliminating unit is smaller than said first AC bias voltage supplied to said charging unit.

* * * * *